US007628386B2

(12) United States Patent
Payne

(10) Patent No.: US 7,628,386 B2
(45) Date of Patent: Dec. 8, 2009

(54) FENCE SYSTEM

(75) Inventor: John F. Payne, Ennis, TX (US)

(73) Assignee: Payne Fence Products, LLC, Ennis, TX (US)

( * ) Notice: Subject to any disclaimer, the term of this patent is extended or adjusted under 35 U.S.C. 154(b) by 0 days.

(21) Appl. No.: 11/110,579

(22) Filed: Apr. 19, 2005

(65) Prior Publication Data

US 2006/0151770 A1 Jul. 13, 2006

Related U.S. Application Data

(60) Provisional application No. 60/642,079, filed on Jan. 7, 2005.

(51) Int. Cl.
*E04H 17/02* (2006.01)

(52) U.S. Cl. ..... 256/47; 256/45

(58) Field of Classification Search ..... 256/1, 256/32, 33, 45, 46–58, DIG. 3
See application file for complete search history.

(56) References Cited

U.S. PATENT DOCUMENTS

| | | | | | |
|---|---|---|---|---|---|
| 1,204,126 | A | * | 11/1916 | Butzer | 256/49 |
| 1,714,388 | A | | 5/1929 | McBride | |
| 3,140,858 | A | | 7/1964 | Westphal | |
| 3,193,255 | A | | 7/1965 | Burdett | |
| 3,323,530 | A | | 6/1967 | Smith | |
| 3,604,686 | A | * | 9/1971 | Parisien | 256/32 |
| 3,734,467 | A | * | 5/1973 | Weeden | 256/24 |
| 3,770,245 | A | | 11/1973 | Murdock | |
| 3,881,699 | A | * | 5/1975 | Nusbaum | 256/59 |
| 4,098,493 | A | * | 7/1978 | Logan | 256/24 |
| 4,255,913 | A | | 3/1981 | Poma | |
| 4,266,757 | A | | 5/1981 | Kirkwood | |
| 5,007,587 | A | * | 4/1991 | Daroca | 256/1 |
| 5,141,207 | A | | 8/1992 | Meglino et al. | |
| 5,275,382 | A | | 1/1994 | Charbaut et al. | |
| 5,341,610 | A | * | 8/1994 | Moss | 52/82 |
| 5,421,557 | A | | 6/1995 | Vise | |
| 5,480,126 | A | | 1/1996 | Teasdale | |
| 5,542,649 | A | * | 8/1996 | Allegaert et al. | 256/47 |
| 5,556,080 | A | | 9/1996 | Vise | |
| 5,676,351 | A | * | 10/1997 | Speece et al. | 256/54 |
| 5,730,426 | A | * | 3/1998 | Tu | 256/54 |
| 5,794,990 | A | * | 8/1998 | Coppedge | 256/65.01 |
| 6,217,007 | B1 | | 4/2001 | Grayson, II et al. | |
| 6,557,666 | B1 | | 5/2003 | Drouin | |
| 6,581,914 | B2 | * | 6/2003 | Saura Sotillos et al. | 256/48 |
| 2003/0209701 | A1 | | 11/2003 | Goddard | |
| 2006/0226406 | A1 | | 10/2006 | Vise | |
| 2007/0272909 | A1 | | 11/2007 | Payne | |

FOREIGN PATENT DOCUMENTS

| | | |
|---|---|---|
| FR | 2785635 | 5/2000 |
| WO | 9611317 | 4/1996 |

* cited by examiner

*Primary Examiner*—Victor MacArthur
(74) *Attorney, Agent, or Firm*—Scheef & Stone, LLP; Jack D. Stone, Jr.

(57) ABSTRACT

In a fence having a plurality of posts, vertically-spaced rails extend across the posts. Horizontally-spaced union strips are extended across the rails, and sheeted infill material is positioned within the open faces of the union strips, so that the sheeted infill material extends from the first union strip to the second union strip.

16 Claims, 36 Drawing Sheets

102
110
2300
2400
2402
2600
2602
2604
2702
1702
1704
2900
2902
2904
2906
3002
24
25
27
28
30
31

102
3206
3202
3204
3200
3206
110
33
34
34
33

102
3202
3200
3302
3204
3302
110

102
3200
3202
3204
3302
3302

3500
3506
3502
3506
3504
102
110
36
37
37
36

102
3500
3502
3506
110

102
3504
3500
3502
3504

3800
3806
3803
3806
3804
3802
110
39
40
40
39

3802
3803
3806
3800
110

3802
3804
3800
3803
3804

3802
4100
4102
4104
4106
4202
110
4400
4402
4404
4406
4502
4700
4702
4704
4802
1702
1704

3802
5000
110
52
52
51
51

3802
5000
5100
5100
5102
5102
110

3802
5000
5100
5102
5102

5300
5302
5304
5306
5306
5308

5400

5500

5600

5700

5800

5900

6000

FENCE SYSTEM

CLAIM OF PRIORITY

This application claims priority from U.S. Provisional Patent Application No. 60/642,079 entitled "FENCE SYSTEM" filed on behalf of John F. Payne on Jan. 7, 2005, and incorporated by reference herein in its entirety.

TECHNICAL FIELD

The invention relates generally to fences and, more particularly, to fences adapted to architectural applications, trellises, and/or to provide high security.

BACKGROUND

Fences are well known in the art for providing security to property. Typically, a fence includes a series of posts set in ground, cement, a concrete slab, or the like, with a fencing infill material spanning between or across the posts. A common type of fencing infill material is chain link. A chain link fence, however, is easy to breach with wire cutters. For example, if one wire of a chain link fence is cut, the integrity of the whole fence is compromised, since chain link is a continuous piece of fabric. It may be appreciated that cutting a wire of chain link fence is analogous to cutting a link of chain, wherein the tension on the complete fence or chain is lost. Once the wire is cut, an opening in the fence may then be readily formed through which a person may readily pass with appropriated goods.

Fencing infill material that is heavier and less susceptible to the aforementioned drawbacks of chain link, such as heavy gauge wire mesh, is also available. However, such heavier fencing material is only manufactured in standard widths, and thus requires that fence posts be spaced apart at very precise intervals, to match the width of the fencing material, so that the heavier fencing material will properly span between the posts. This problem is particularly acute when one fencing material (e.g., chain link) that has been hung between posts spaced at certain intervals is to be replaced with fencing infill material (e.g., heavy gauge wire mesh) that requires different and more precise post spacing intervals. In such cases, the old posts, which are typically embedded in cement or a concrete slab, must be removed and new posts must be installed (requiring core drilling in concrete slabs) at precise spacing intervals. Once new posts are set at proper spacing intervals, fencing material must be manufactured into panels by putting a frame, such as angle iron, around them. The fabricated panels are preferably also galvanized to prevent rust. The fabricated panels of fencing infill material are then installed individually between the posts.

Another fencing infill material that has been used to construct fences which are less susceptible to the aforementioned drawbacks of chain link is expanded metal, as exemplified by U.S. Pat. Nos. 5,421,557 and 5,556,080 to Vise. However, in addition to the many of the drawbacks mentioned above, expanded metal typically includes sharp edges which is prone to cut people, thereby creating a potential liability for users of expanded metal. Because expanded metal must be overlapped at joints, as indicated in the Vise patents, the potential for there to be sharp edges which could cut people, and thus increase potential liability, is increased even further.

Therefore, what is needed is a system and method for incorporating any standard sheeted fencing (infill) material into a secure fence with posts spaced apart by non-standard intervals. Such system and method should, among other things, accommodate posts of virtually any size, cross-section, and spacing. Still further, such system and method should preferably be easy to install, not require fabrication of a frame for panels of fencing material, and therefore, no post-fabrication galvanization, and should preferably also be aesthetically appealing and not have sharp edges which are prone to cut people.

SUMMARY

The present invention, accordingly, provides a fence having a plurality of posts. Vertically-spaced rails extend substantially horizontally across the posts, and horizontally-spaced union strips defining at least one channel are extended substantially vertically across the rails. Sheeted infill material is positioned within channels of the union strips, so that the sheeted infill material extends between union strips, and thereby form a fence system.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
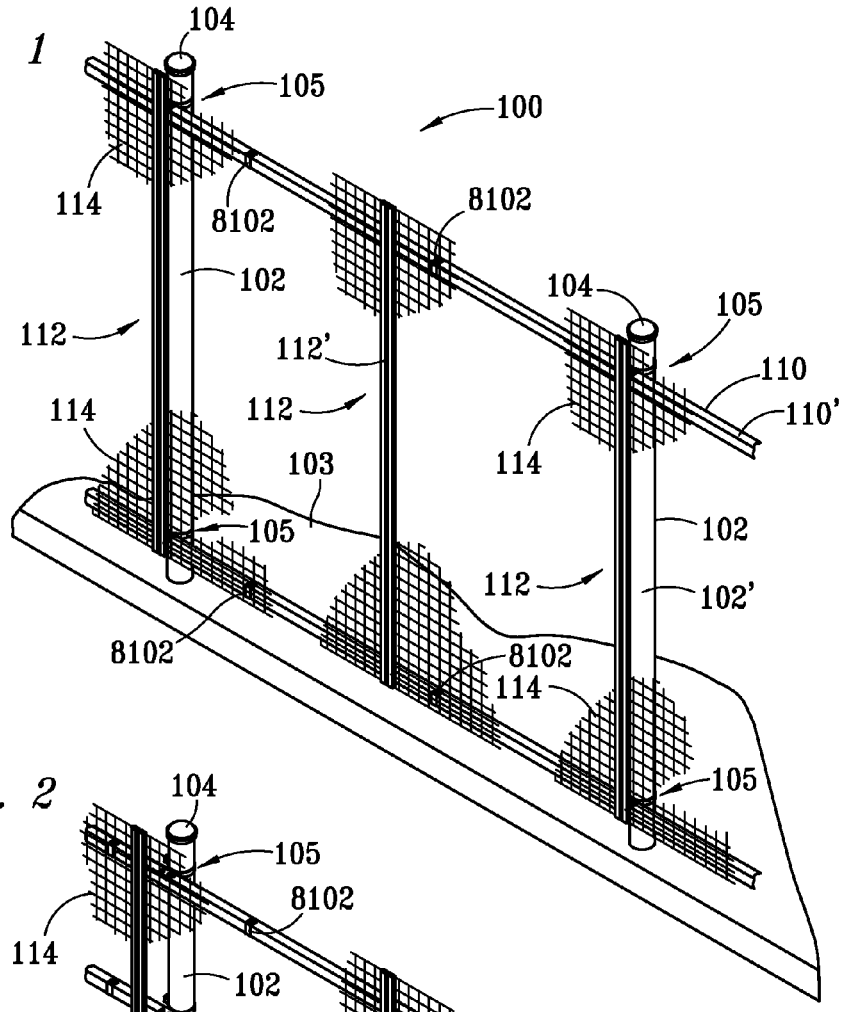
FIG. 1 presents a perspective view of a portion of one preferred embodiment of a fence system embodying features of the present invention.

Refer now to the drawings wherein depicted elements are, for the sake of clarity, not necessarily shown to scale, and wherein like or similar elements may be designated by the same reference numeral through several views.

Figure 4:
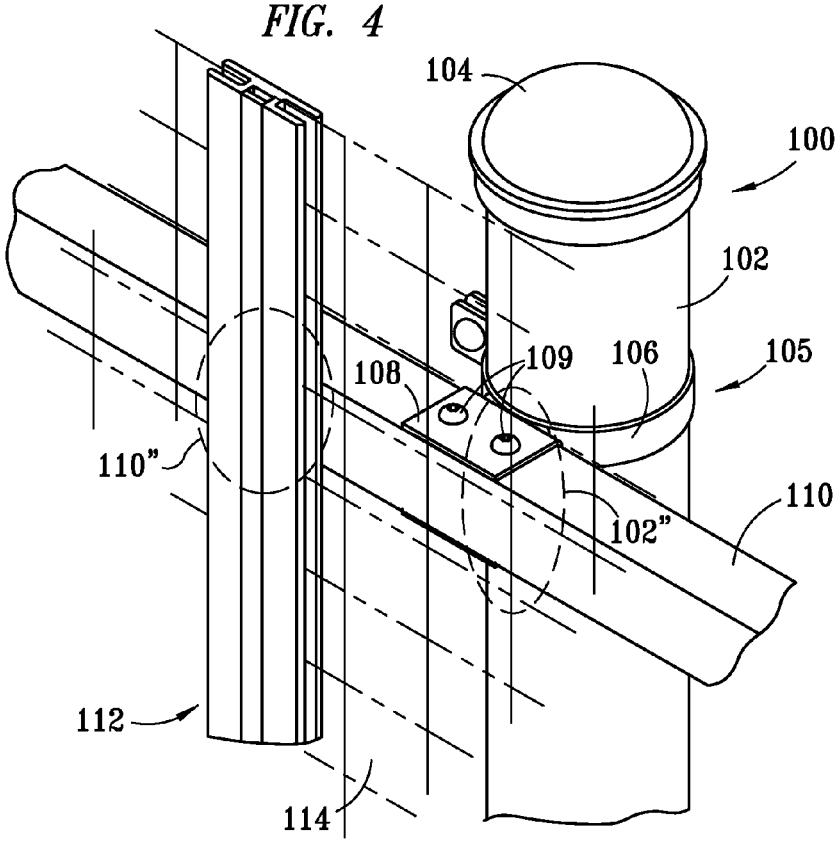
FIG. 4 presents a perspective view of a portion of the fence of FIG. 2 having an offset channel.

Referring to FIG. 1 of the drawings, the reference numeral 100 generally designates a fence system embodying features of the present invention. The fence system 100 preferably includes a number of posts 102 (two of which are shown in FIG. 1), which reference numeral 102 generally designates a longitudinal surface thereof as well, and each of which posts define a longitudinal surface 102' and preferably include a conventional cap 104 positioned at the top of each respective post. The posts 102 may be of any desired length (e.g., four, eight, or twenty feet), of any desired cross-section (e.g., round, square, elliptical, I-beam, angle iron, and the like), of any desired material (e.g., wood, steel, and the like) and set substantially vertically in cement, a concrete slab, or the like, 103 in any conventional manner as desired. As described in further detail below, in a preferred embodiment of the invention, at least one substantially horizontal rail 110 is attached to, and defines a longitudinal surface 110' which extends across a portion 102" (FIG. 4) of a longitudinal surface 102' of, at least one post 102; at least two substantially vertical union strips 112 are attached to, and define respective longitudinal surfaces 112' which extend across a portion 110" (FIG. 4) of the longitudinal surface 110' of, the at least one rail 110; and infill material 114 which is retained by the union strips 112. Infill material 114 is preferably further retained to the rails 110 by clips, exemplified by clips 8102, such clips being described in further detail below with respect to FIGS. 71-88. The infill material 114 may comprise any material effective for running between union strips 112, such as, by way of example and not limitation, wire mesh, woven wire mesh, welded wire mesh, expanded metal mesh, perforated panel, steel grate panel, solid sheets of steel, stainless steel, aluminum, plastic, and the like.

Figure 2:
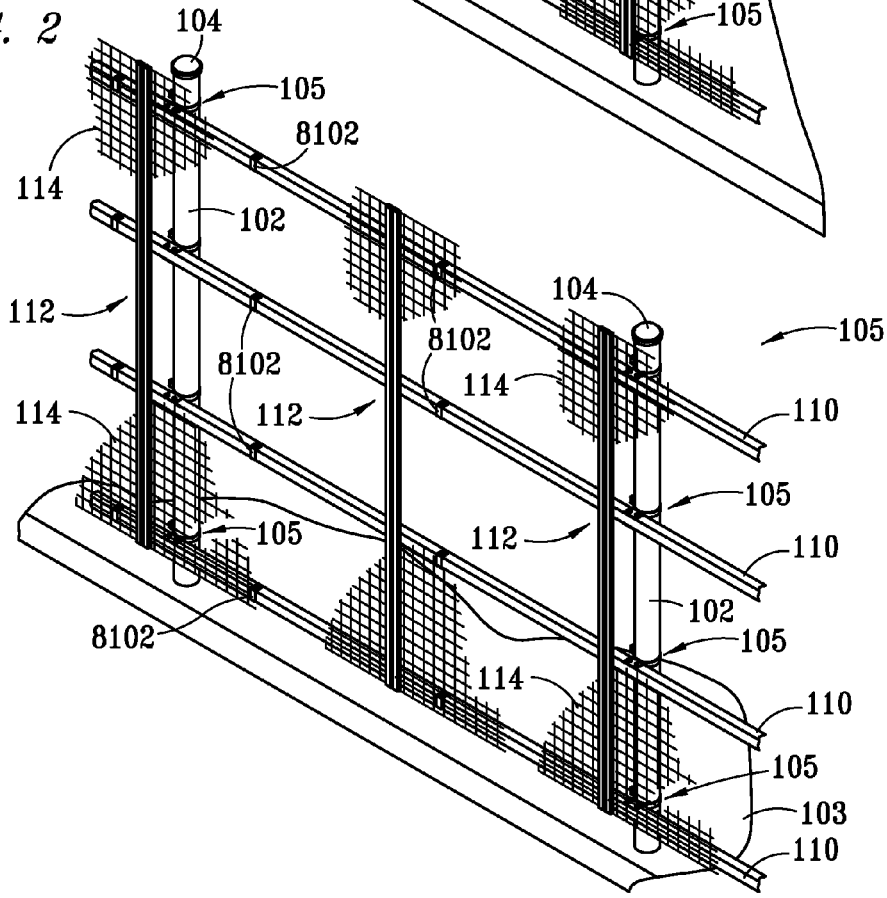
FIG. 2 presents a perspective view of one alternative embodiment of the fence of FIG. 1.

As exemplified by FIG. 2, the fence system 100 may comprise four, or any number of, rails 110, and there is no necessity for the union strips 112 to be aligned with the posts 102. That the union strips 112 may be aligned or offset from the posts 102 of FIGS. 1 and 2 is further depicted by FIGS. 3 and 4, respectively.

Each rail 110 is preferably secured to each of two or more posts 102 via a rail hanger 105. As shown more clearly in FIGS. 3 and 4, each rail hanger preferably comprises a conventional clamp 106 attached to a post 102, to which clamp a bracket 108 is attached (e.g., welded). The rail 110 is secured to each bracket 108 via conventional fasteners, such as screws, bolts and nuts, and/or the like.

Figure 3:
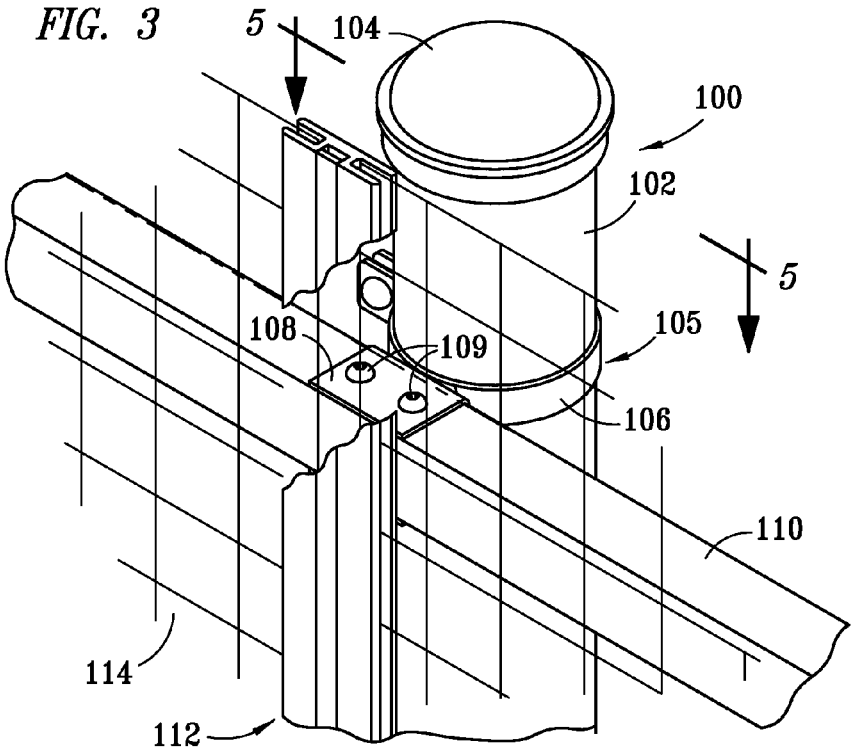
FIG. 3 presents a perspective view of a portion of the fence of FIG. 1.
Figure 5:
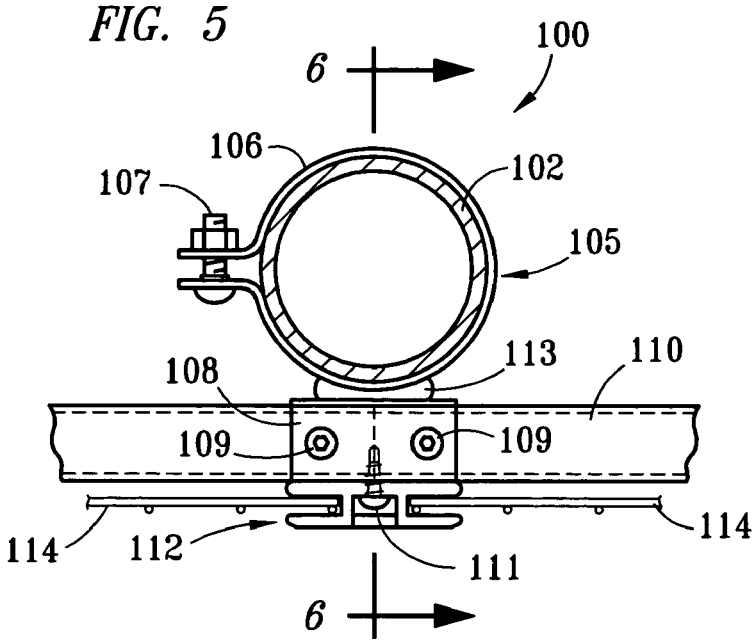
FIG. 5 presents a plan cross-sectional view of the portion of the fence of FIG. 1 taken along the line 5-5 of FIG. 3.

FIG. 5 is a plan cross-sectional view of the portion of the fence of FIG. 1 taken along the line 5-5 of FIG. 3. As shown therein, the rail hanger 105 preferably includes a clamp 106, and a bolt and nut 107 to tighten the clamp 106 about the post 102. The bracket 108 is preferably welded at a weld joint 113 to the clamp 106, and the rail 110 is secured to the bracket 108 preferably via four fasteners 109 (two of which are shown in each of FIGS. 3-5, and two of which are preferably utilized on the opposing side of the bracket 108, as shown more clearly in FIG. 6), although more or less than four fasteners may be utilized, such fasteners including, by way of example, but not limitation, self-tapping screws, screws with break-away nuts, rivets, and/or the like. As discussed in further detail below, the union strip 112 is preferably secured to each rail 110 via at least one fastener 111 such as, by way of example, self-tapping screws, screws with break-away nuts (FIG. 17), rivets, and/or the like.

Figure 6:
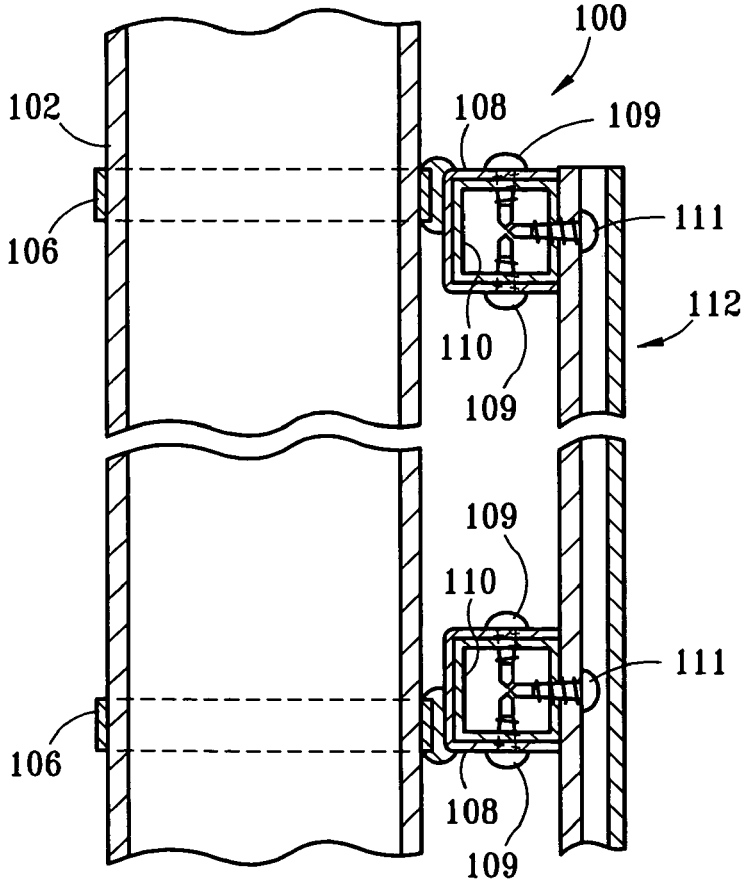
FIG. 6 presents a cross-sectional elevation view of the fence portion of FIG. 1 taken along the line 6-6 of FIG. 5.

FIG. 6 presents a cross-sectional elevation view of the fence portion of FIG. 1 taken along the line 6-6 of FIG. 5. As shown therein, the clamp 106 of each rail hanger 105 is vertically offset from its respective bracket 108, to thereby allow two rail hangers 105 to be complementarily secured to a post 102 for supporting two rails at the same height (e.g., at a corner of a fence), as exemplified and discussed in further detail below with respect to FIGS. 8 and 9.

Figure 7:
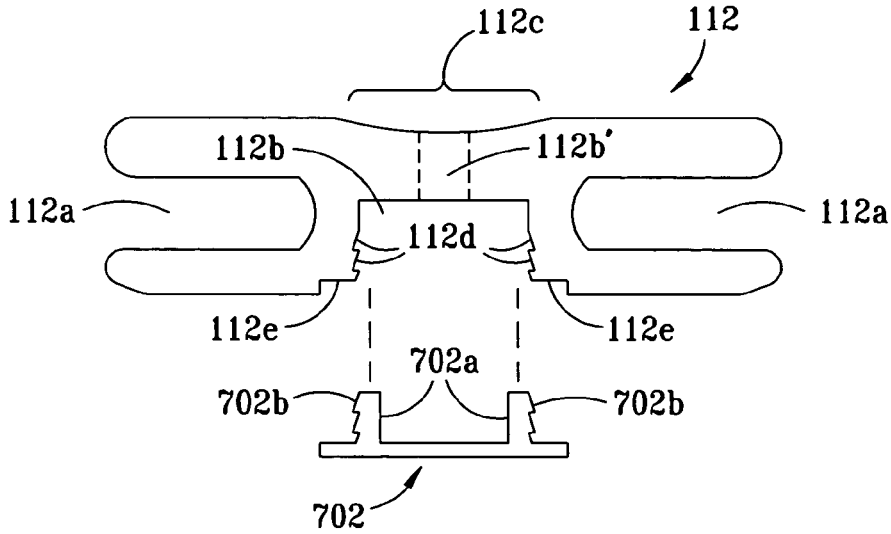
FIG. 7 presents a plan view of a union strip embodying features of the present invention for securing wire mesh to a fence system.

FIG. 7 presents a plan view of the union strip 112 embodying features of the present invention for securing infill material 114 to a fence system embodying features of the present invention. As shown therein, the union strip 112 preferably defines two channels 112*a*, though the union strip 112 may include but a single channel 112*a* where suitable, such as a termination point or corner of a fence. A center channel 112*b* is preferably formed in the union strip 112 between the channels 112*a*, and a hole 112*b*' is formed in the center channel 112*b* for facilitating the passage of a fastener 111 through the hole and to a rail 110 (not shown in FIG. 7), to thereby secure the union strip 112 to the rail 110. The center channel 112*b* further includes ratchet teeth 112*d* and an extended opening portion 112*e*. A cover strip 702 having projections 702*a* and ratchet teeth 702*b* is preferably configured for matingly engaging the center channel 112*b* and ratchet teeth 112*d*, and thereby precluding access to the fasteners 111 and enhancing security of the fence system 100. The union strip 112 preferably also defines a concave radius 112*c* opposing the center channel 112*b* for providing a spring action effective for enabling a fastener 111 to be securely tightened and, for certain configurations wherein a union strip directly abuts a post 102, for enabling the union strip 112 to seat against the post 102.

Figure 8:
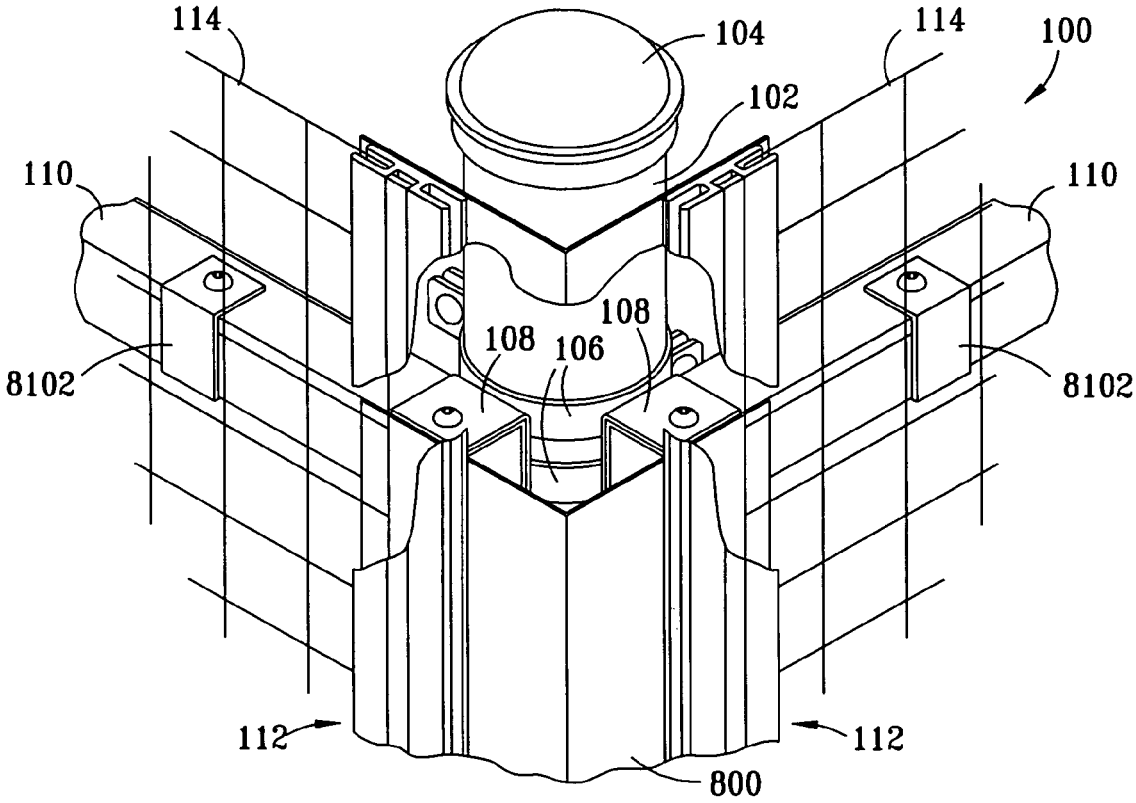
FIG. 8 exemplifies an embodiment of a fence portion of FIG. 1 adapted for securing an exterior corner in a fence system embodying features of the present invention.

FIG. 8 depicts a corner strip 800 adapted for securing an exterior corner of the fence system 100. The corner strip 800 preferably comprises sheet metal fabricated with a 90° bend in it, although the angle of the bend could be any angle suitable for the fence system 100, and could comprise multiple angles, such as two 45° angles instead of a single 90° angle. While not shown, the corner strip 800 is preferably mounted by passing a fastener, such as a self-tapping screw or the like, the hole 112*b*' and into the rail 110 securing the corner strip 800 thereto.

Figure 9:
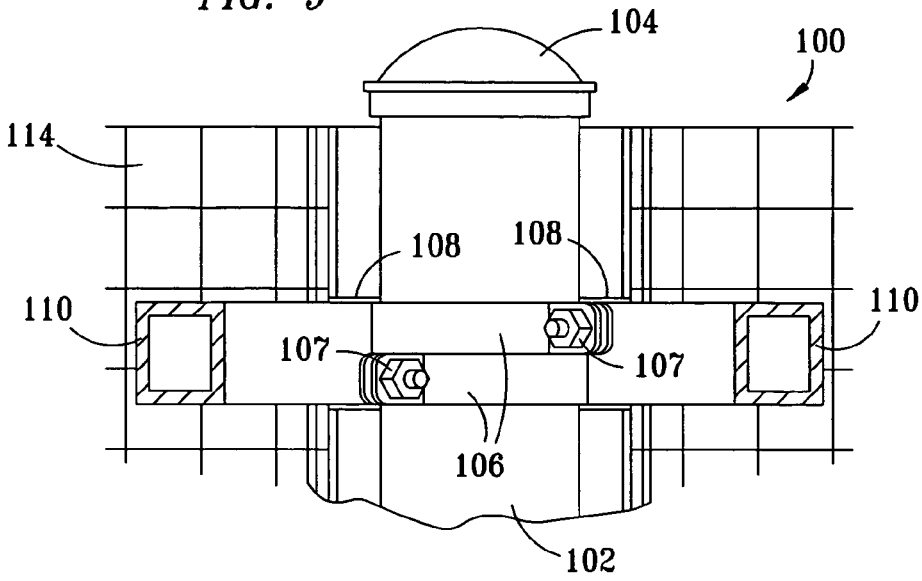
FIG. 9 presents an elevation view of the fence of FIG. 8 viewed from a back side of FIG. 8.

FIG. 9 presents an elevation view of the portion of the fence system 100 of FIG. 8 viewed from a back side of FIG. 8. As shown therein, and further to the discussion above with respect to FIG. 6, the clamps 106 are complementarily positioned relative to each other to permit two rails 110 to be supported at a common height from the same post 102.

Figure 10:
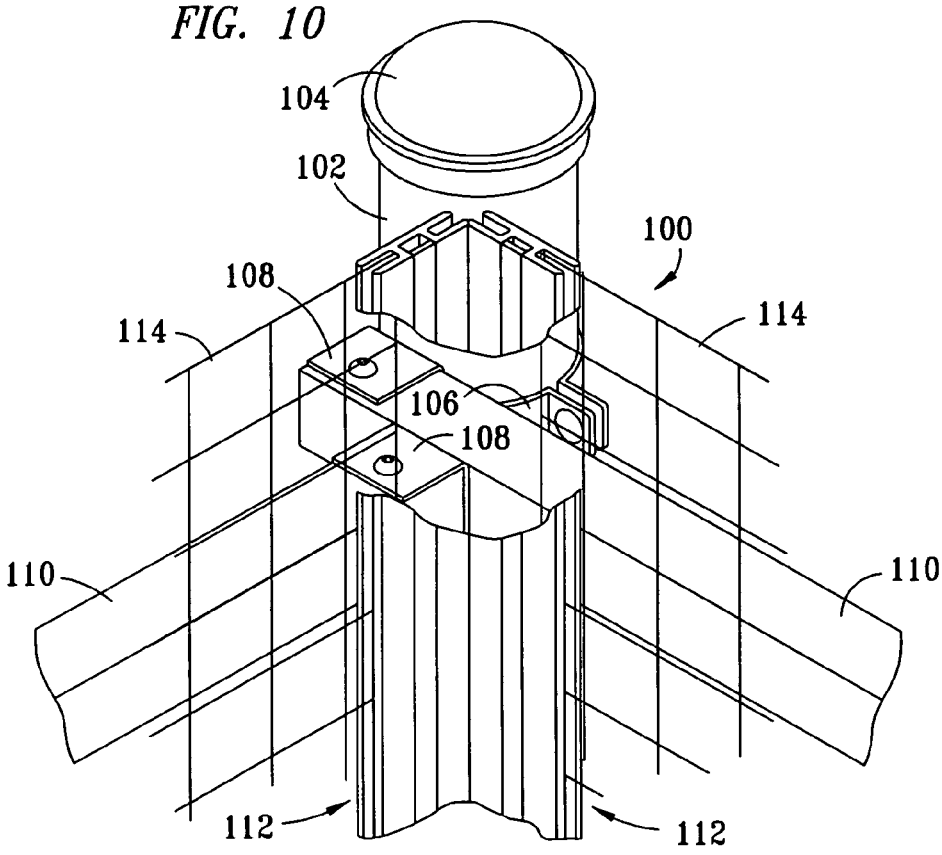
FIG. 10 exemplifies an alternative embodiment of the fence portion of FIG. 1 adapted for securing an interior corner in a fence system embodying features of the present invention.

FIG. 10 depicts an embodiment of a portion of the fence system 100 adapted for securing an interior corner in the fence system. Accordingly, two union strips 112 are preferably positioned on respective rails 110 so that they substantially abut one another, thereby obviating the need for the corner strip 800 discussed above with respect to the external corner depicted in FIG. 8. The rails 110 may be interconnected using any of a number of conventional techniques, such as discussed below with respect to FIGS. 97 and 98.

Figure 11:
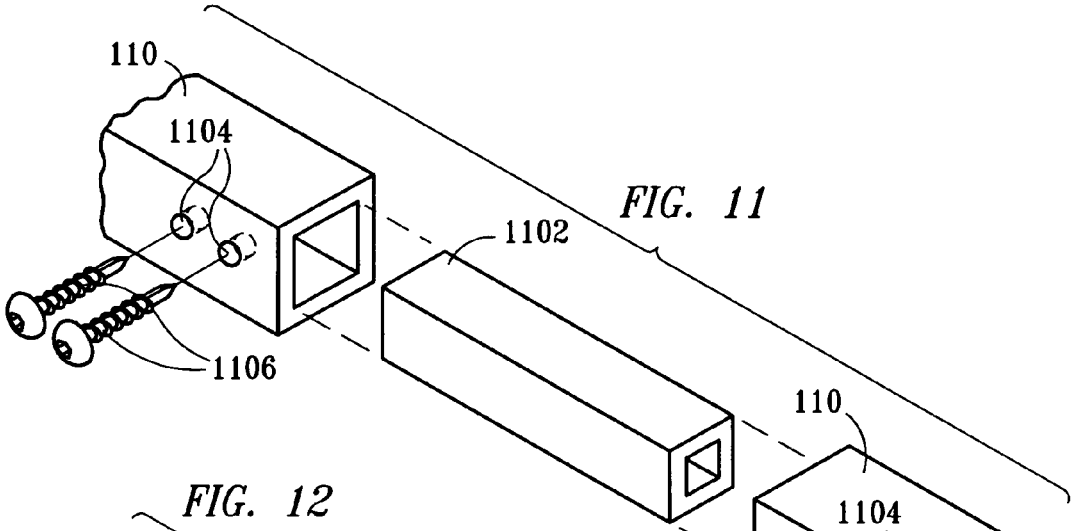
FIG. 11 exemplifies one embodiment for coupling rails together in accordance with principles of the present invention.
Figure 12:
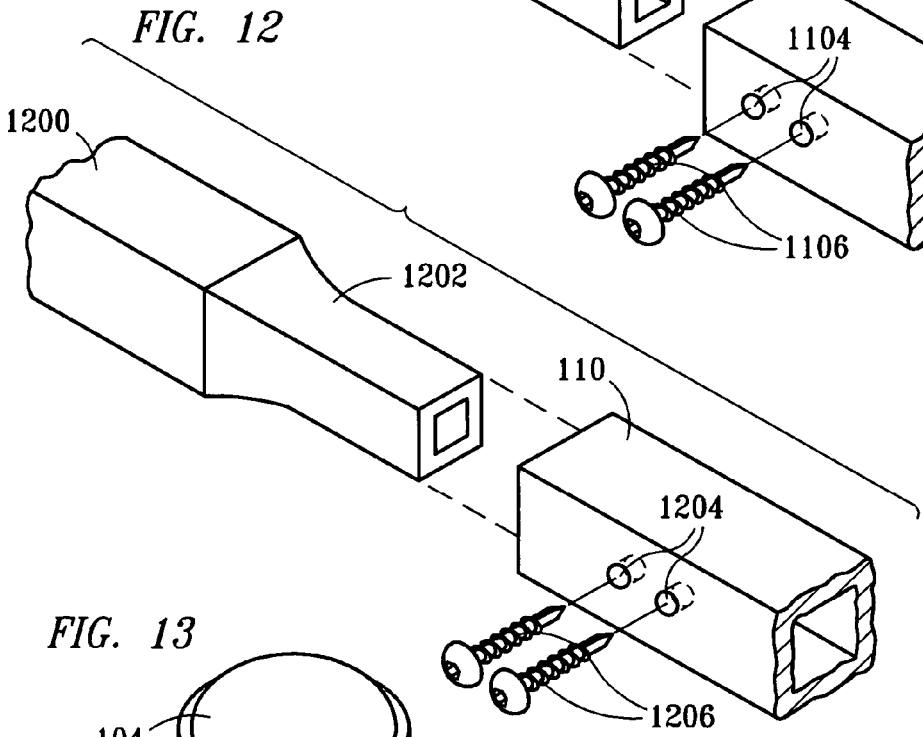
FIG. 12 exemplifies an alternative embodiment for coupling rails together in accordance with principles of the present invention.

FIGS. 11 and 12 depict two embodiments for coupling co-linear rails 110 together in accordance with principles of the present invention. In FIG. 11, an intermediate coupler 1102 is configured for fitting within the ends of two rails 110 to connect together the two rails. One or more holes 1104 are formed in each of the rails 110 to be coupled, so that when the rails 110 receive the coupler 1102, a fastener 1106, such as a self-tapping screw, or the like, may be extended through each hole 1104, and into the intermediate coupler 1102 to thereby secure together the two rails 110 via the coupler 1102. In FIG. 12, one rail 110, designated by the reference numeral 1200, is swaged at one end 1202 to fit within a corresponding rail 110, and one or more holes 1204 are defined in the rail 110, through each of which holes 1204 a fastener 1204, such as a self-tapping screw, or the like, is extended into the swaged end 1202 of the rail 1200 to secure together the two rails 110 and 1200.

Figure 13:
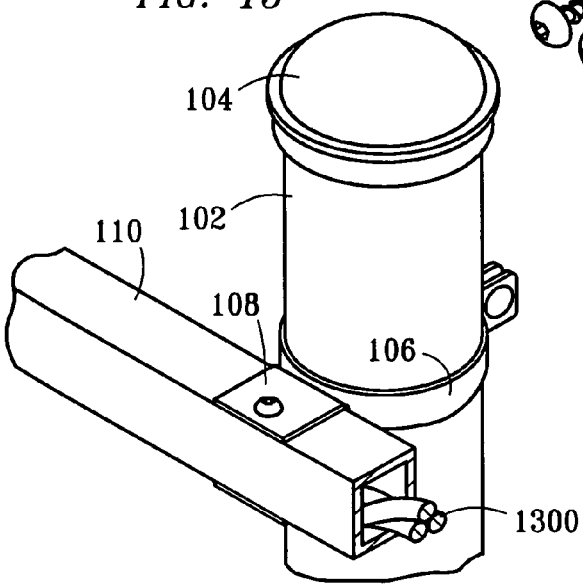
FIG. 13 exemplifies an alternative embodiment of a rail having cable extending through it for enhancing the security of a fence system embodying features of the present invention.

FIG. 13 presents a rail 110 having a cable 1300 extending through it for enhancing the security of the fence system 100. The cable 1300 is preferably secured at each end of the rail 110 to a relatively immovable object, such as a monument, anchor in the ground, or the like.

Figure 14:
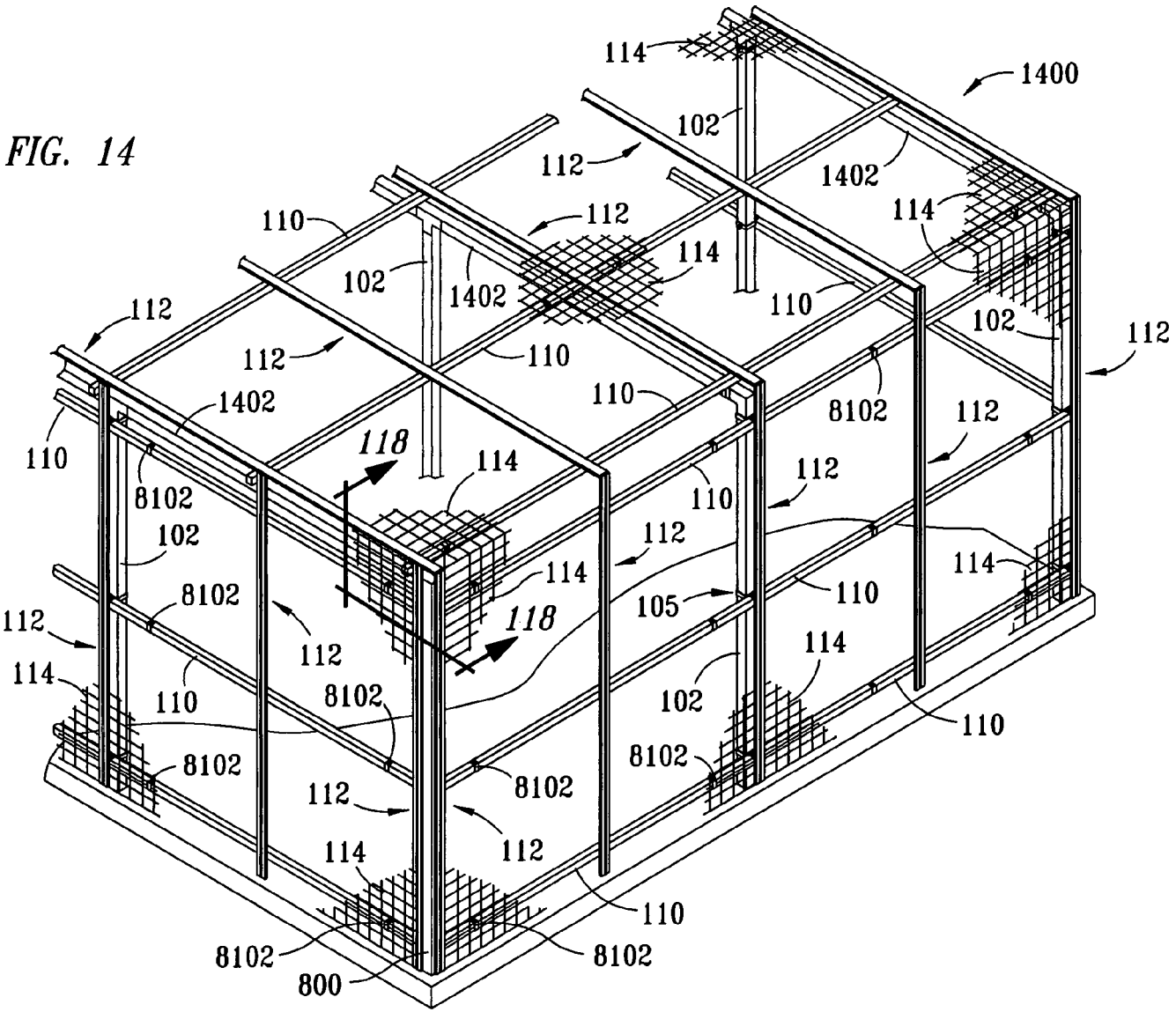
FIG. 14 exemplifies one embodiment of a fence system configured as an enclosure having infill material positioned on the exterior of the enclosure and extending across the top of the enclosure in accordance with principles of the present invention.

FIG. 14 exemplifies an embodiment of the present invention having infill material extending across the top of the fence system, to thereby form an enclosure 1400, such as a tool bin in a retail store. As shown therein, and as discussed in further detail below with respect to FIGS. 118 and 119, the rafters 1402 extend between the tops of posts 102, rails 110 extend across the rafters 1402, and union strips 112 extend across the rails 110. Infill material 114 is then positioned in, and retained by, the channels 112*a* of the union strips 112, and further retained to the rails via clips, such as the clips 8102, to secure the top of the enclosure 1400.

Figure 118:
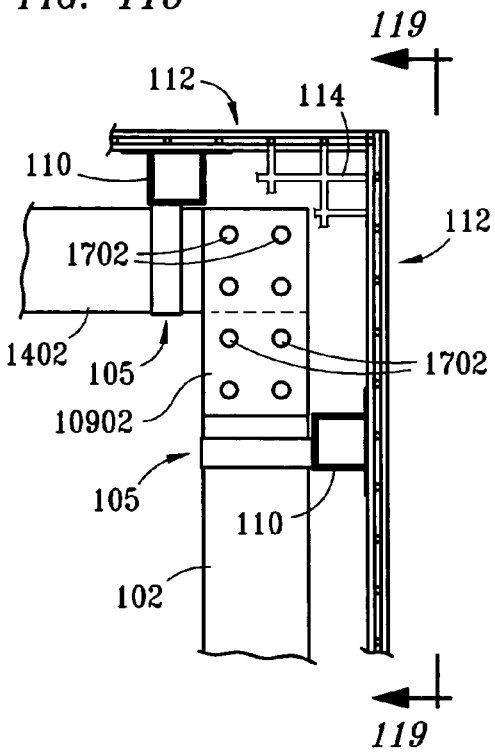
FIG. 118 presents an elevation view taken along the line 118-118 of FIG. 14 of one preferred embodiment for securing of a rafter to a post of the enclosure of FIG. 14.
Figure 119:
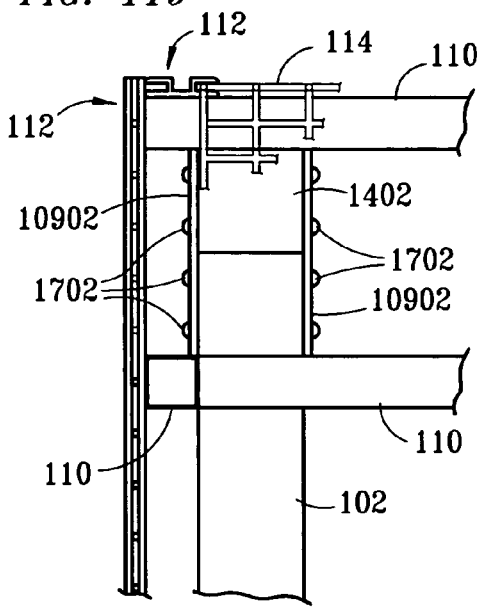
FIG. 119 presents an elevation view taken along the line 119-119 of FIG. 118.

Referring to FIGS. 118 and 119, there is depicted one preferred embodiment for securing a rafter 1402 to a post 102. Accordingly, the rafter 1402 is preferably positioned on top of the post 102, and is secured thereto by two plates 10902 (only one of which is shown in FIG. 118) fastened to both the rafter 1402 and the post 102 via conventional fasteners, such as the bolt 1702 or 1802 and nut 1704, described in further detail below with respect to FIGS. 17 and 18. Rails 110 are secured to the post 102 and rafter 1402 via rail hangers, such as the rail hangers 105 described above with respect to FIGS. 3-5. As also described above, union channels 112 are secured to the rails 110, and infill material 114 is positioned in, and retained by, the union channels 112, and further retained to the rails via clips, such as the clips 8102.

Figure 15:
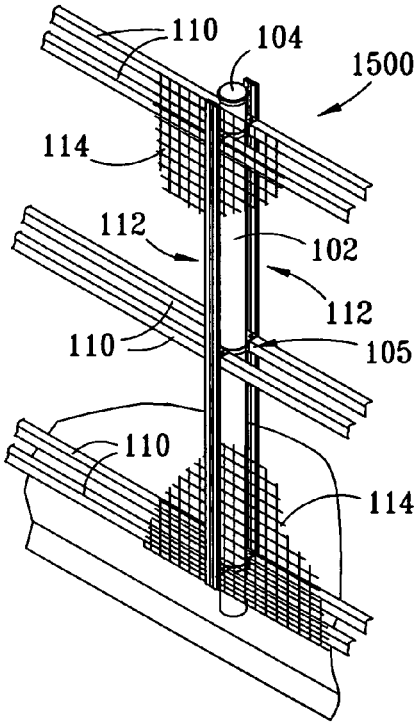
FIG. 15 exemplifies an alternative embodiment of the present invention wherein rails, union strips, and infill material are positioned on each of two sides of a fence system embodying features of the present invention.

FIG. 15 presents an alternative embodiment 1500 of the present invention wherein rails 110, union strips 112, and infill material 114, such as wire mesh, is secured to two sides of a fence system, to thereby provide additional security. It may be appreciated that the rails 110, union strips 112, and wire mesh 114 may be different on each side, as desired.

Figure 16:
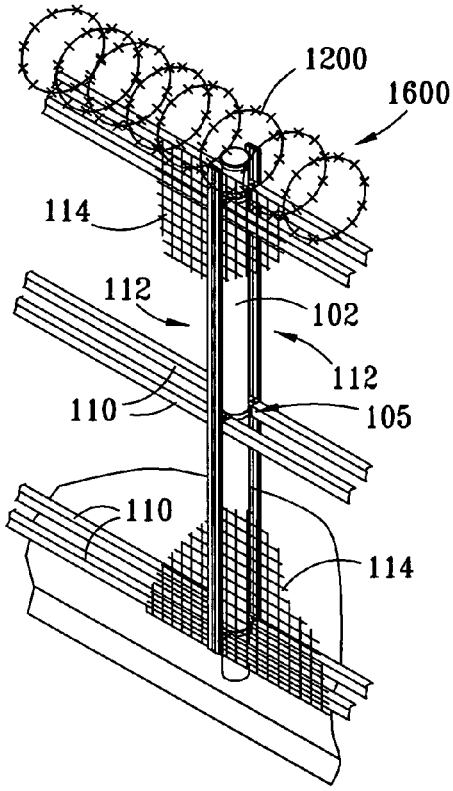
FIG. 16 exemplifies an alternative embodiment of the fence system of FIG. 15 wherein Constantina (also known as concertina) wire is positioned atop a fence system embodying features of the present invention.

FIG. 16 presents an alternative embodiment 1600 of the present invention wherein barbed wire, such as Constantina (also known as concertina) wire (i.e., barbed wire that is extended in a spiral for use as a barrier), is positioned atop the fence system of FIG. 15, to thereby provide still further security.

Figure 17:
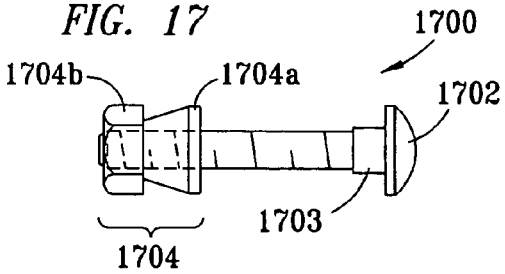
FIG. 17 exemplifies a bolt having a carriage head and break-away nut adapted for use in the present invention.

FIG. 17 depicts a bolt (or screw) 1700 preferably having a carriage type of head 1702 (i.e., a "dome-shaped" head with no driver slot) and square shoulder 1703, and configured for receiving a nut 1704, adapted for use in the present invention. The nut 1704 preferably comprises a main portion 1704*a* having a conical type head, and a breakaway portion 1704*b* configured for breaking away from the main portion 1704*a* upon the application of a predetermined amount of torque, thereby rendering the main portion 1704*a* on the bolt 1700 not readily removable, thereby enhancing security still further.

Figure 18:
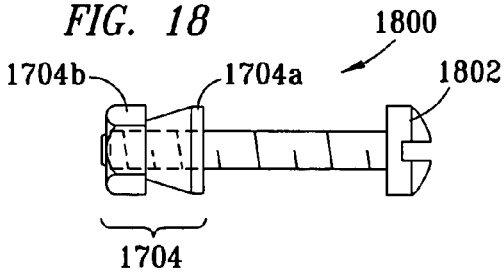
FIG. 18 exemplifies a bolt having a pan head and a break-away nut adapted for use in the present invention.

FIG. 18 depicts a bolt (or screw) 1800 similar to the bolt (or screw) 1700, but for having a pan type of head 1802 (i.e., a head with a driver slot, such as a Phillips head, a square head, or the like), no square shoulder 1703, and configured for receiving the breakaway nut 1704, for use in the present invention.

Figure 19:
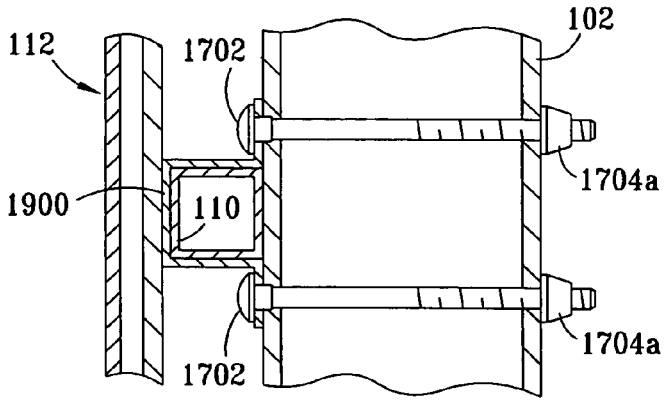
FIG. 19 presents a partial cross-sectional elevation view of one embodiment of a bolt and breakaway nut for securing a rail to a post of a fence system embodying features of a fence system embodying features of the present invention.

FIG. 19 presents a cross-sectional elevation view of an alternative embodiment of a rail hanger for securing a rail 110 to a post 102 of the fence system of FIG. 1, wherein a bracket 1900 wraps around the rail 110. As shown therein, bolts 1702 are extended through the bracket 1900 and post 102, and then secured thereto via a nut, such as the nut 1704 described above with respect to FIG. 17, to thereby secure the bracket 1900 and rail 110 to the post 102.

Figure 20:
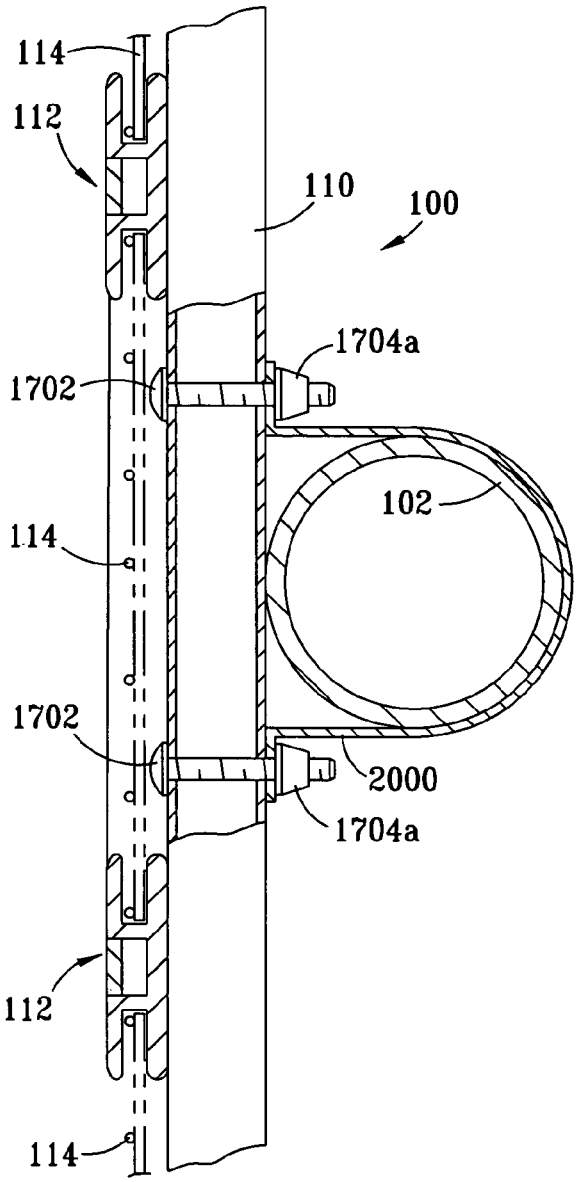
FIG. 20 presents a plan cross-sectional view of one embodiment of a bracket for securing a rail to a post of a fence system embodying features of the present invention.

FIG. 20 presents a plan, partial cross-sectional view of an alternative embodiment of a rail hanger for securing a rail 110 to a post 102 of the fence system 100, wherein a rail hanger bracket 2000 wraps around the post 102. As shown therein, bolts (or screws) 1702 extend from the rail 110 into the bracket 2000 and are secured thereto via a nut, such as the nut 1704, described above with respect to FIG. 17, to thereby secure the rail to the post 102.

Figure 21:
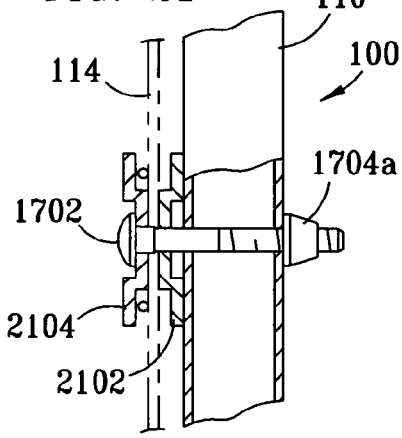
FIG. 21 exemplifies a plan view of an alternative embodiment of a union strip configured for securing infill material to a fence system embodying features of the present invention.

FIG. 21 presents a plan view of alternative means for securing infill material 114 to a rail 110 of the fence system 100. Accordingly, a first shaped bar, or strip, 2102, extending perpendicularly into the figure, as viewed in FIG. 21, is positioned against the rail 110, and a second shaped bar, or strip, 2104 similar to the first strip 2102, is positioned to abut the first strip 2102 and form channels similar to the channels 112*a*, and the strips 2102 and 2104 are secured to the rail 110 via a fastener, such as the bolt 1702 and nut 1704, a conventional screw, bolt, or the like, extended through holes suitably defined in the strips 2102 and 2104. Infill material 114 is sandwiched in the channels formed between the strips 2100 and 2102. The strips 2102 and 2104 are preferably fabricated from metal, such as steel or aluminum, or from a plastic, fiberglass, or the like, effective for securing the infill material 114 to the rails 110.

Figure 22:
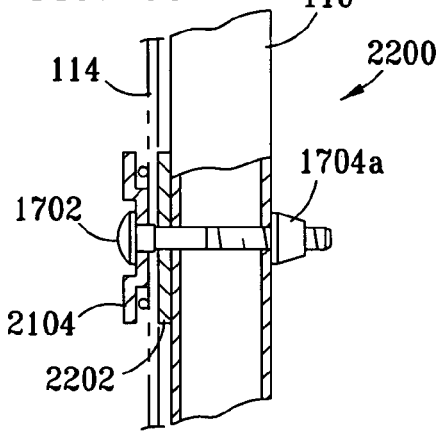
FIG. 22 exemplifies a plan view of a further alternative embodiment of a union strip configured for securing infill material to a fence system embodying features of the present invention.

FIG. 22 depicts an alternative embodiment 2200 of the fence system 100 similar to the embodiment described above with respect to FIG. 21, but for incorporating a flat bar, or strip, 2202 in place of the shaped strip 2102. The strips 2202 and 2104 are positioned to abut one against the other and form channels similar to the channels 112*a* into which infill material 114 is positioned.

Further to the rail hangers described above with respect to FIGS. 3-5, 19, and 20, FIGS. 23-52 exemplify additional alternative embodiments that may be implemented for mounting a rail 110 to a post 102 in accordance with principles of the present invention.

Figures 23, 24, 25, 26, 27, 28, 29, 30, 31:
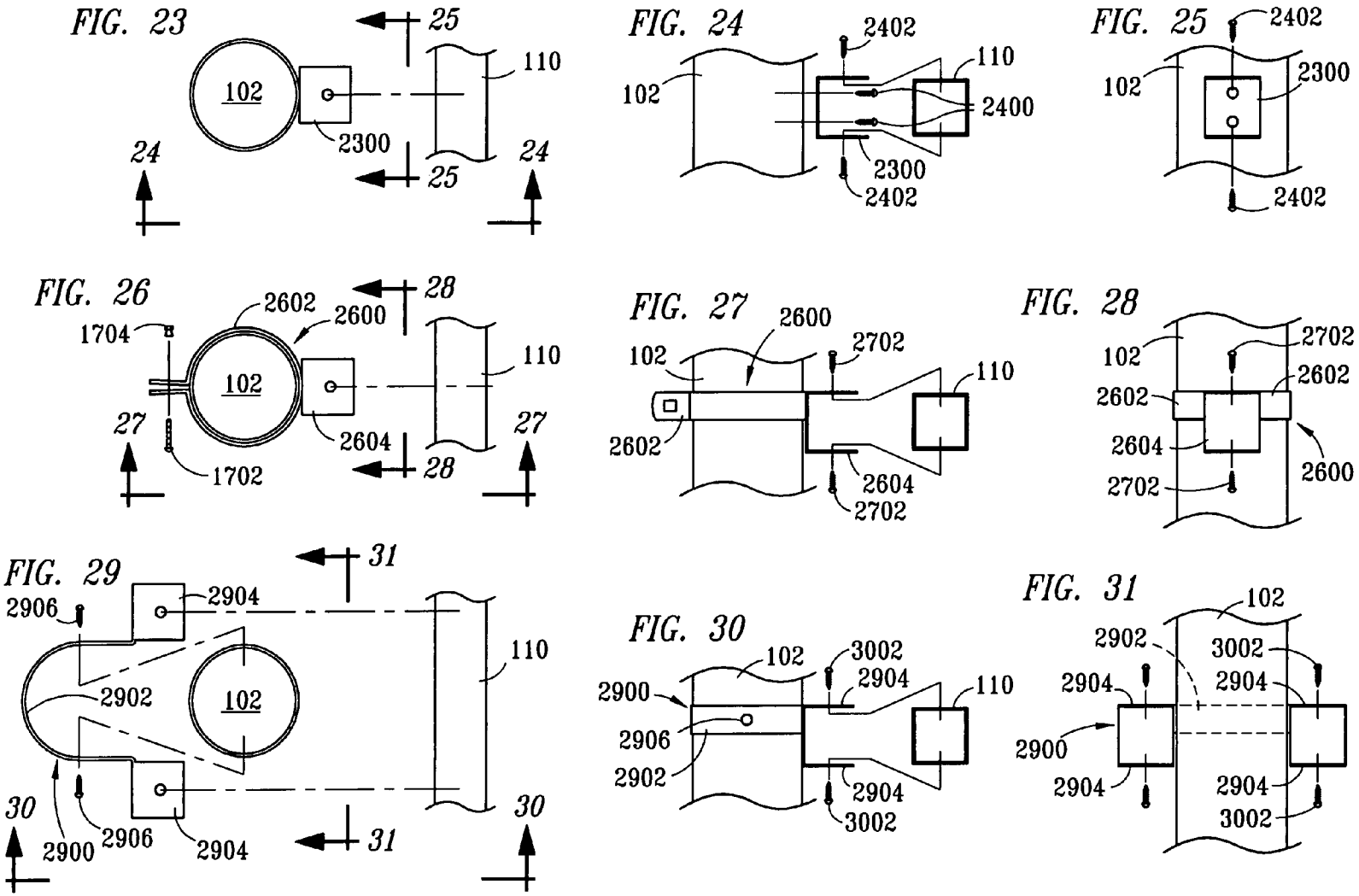
FIGS. 23-25 exemplify one plan view and two elevation views, respectively, of a bracket which may be adapted for securing a rail to a post of a fence system embodying features of the present invention.
FIGS. 26-28 exemplify one plan view and two elevation views, respectively, of an alternative bracket which may be adapted for securing a rail to a post of a fence system embodying features of the present invention.
FIGS. 29-31 exemplify one plan view and two elevation views, respectively, of an alternative bracket which may be adapted for securing a rail to a post of a fence system embodying features of the present invention.

FIGS. 23-25 depict one plan view and two elevation views, respectively, of one embodiment of a rail hanger 2300 adapted for mounting a rail 110 to a post 102 via a bracket 2300. As shown in FIG. 24, two or more fasteners 2400, such as self-tapping screws, rivets, or the like, are preferably utilized to secure the bracket 2300 directly to the post 102, and two or more fasteners 2402 are preferably utilized to secure the rail 110 to the bracket 2300. It will be appreciated that two opposing fasteners 2402 may be replaced by a single longer fastener, such as the bolt 1702 and nut 1704 described above with respect to FIG. 17.

FIGS. 26-28 depict one plan view and two elevation views, respectively, of one embodiment of a rail hanger 2600 adapted for mounting a rail 110 to a post 102. As shown in FIG. 26, the rail hanger 2600 comprises a clamp 2602 and a bracket 2604 secured (e.g., welded) to the clamp 2602. The clamp 2602 includes a fastener, such as a bolt 1702 and nut 1704 to secure the clamp to the post 102. As shown in FIGS. 27-28, two or more fasteners 2702, such as self-tapping screws, rivets, or the like, are preferably utilized to secure the rail 110 to the bracket 2604. It will be appreciated that two opposing fasteners 2702 may be replaced by a single longer fastener, such as the bolt 1702 and nut 1704 described above with respect to FIG. 17.

FIGS. 29-31 depict one plan view and two elevation views, respectively, of one embodiment of a rail hanger 2900 adapted for mounting a rail 110 to a post 102. As shown in FIG. 29, the rail hanger 2900 comprises a semi-circular wrap 2902 and two brackets 2904 secured (e.g., welded) to the wrap 2902. Preferably two or more fasteners 2906, such as self-tapping screws, rivets, or the like, are provided for securing the wrap 2902 to the post 102. As shown in FIGS. 30-31, four or more fasteners 3002 (only two of which are depicted in FIG. 30), such as self-tapping screws, rivets, or the like, are preferably utilized to secure the rail 110 to the bracket 2904. It will be appreciated that two opposing fasteners 2906 or 3002 may be replaced by a single longer fastener, such as the bolt 1702 and nut 1704 described above with respect to FIG. 17.

Figures 32, 33, 34, 35, 36, 37, 38, 39, 40:
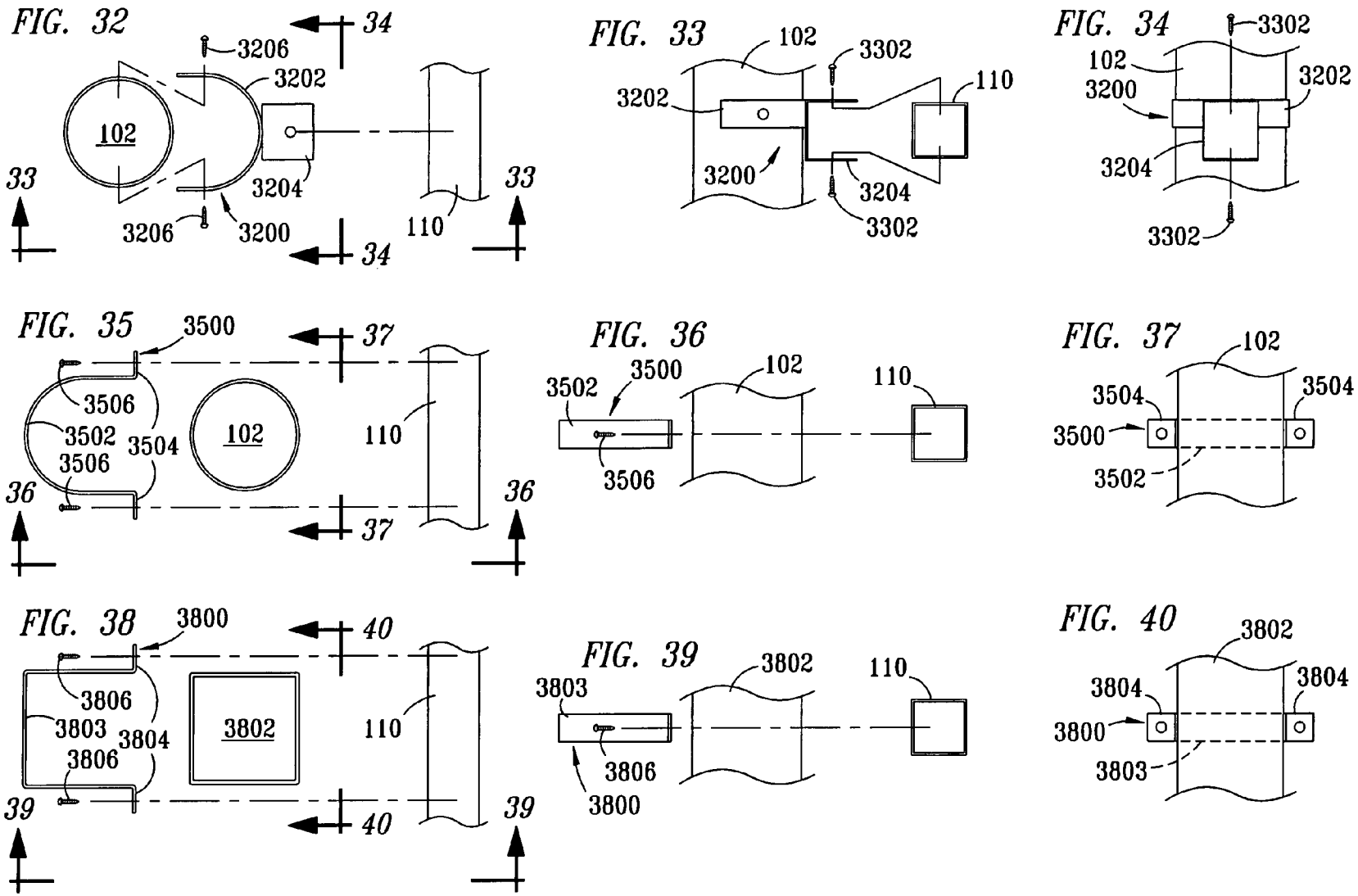
FIGS. 32-34 exemplify one plan view and two elevation views, respectively, of an alternative bracket which may be adapted for securing a rail to a post of a fence system embodying features of the present invention.
FIGS. 35-37 exemplify one plan view and two elevation views, respectively, of an alternative bracket which may be adapted for securing a rail to a post of a fence system embodying features of the present invention.
FIGS. 38-40 exemplify one plan view and two elevation views, respectively, of an alternative bracket which may be adapted for securing a rail to a post of a fence system embodying features of the present invention.

FIGS. 32-34 depict one plan view and two elevation views, respectively, of one embodiment of a rail hanger 3200 adapted for mounting a rail 110 to a post 102. As shown in FIG. 32, the rail hanger 3200 comprises a semi-circular wrap 3202 and a bracket 3204 secured (e.g., welded) to the wrap 3202. Preferably two or more fasteners 3206, such as-self-tapping screws, rivets, or the like, are provided for securing the wrap 3202 to the post 102. As shown in FIGS. 33-34, at least two fasteners 3302, such as self-tapping screws, rivets, or the like, are preferably utilized to secure the rail 110 to the bracket 3204. It will be appreciated that two opposing fasteners 3206 or 3302 may be replaced by a single longer fastener, such as the bolt 1702 and nut 1704 described above with respect to FIG. 17.

FIGS. 35-37 depict one plan view and two elevation views, respectively, of one embodiment of a rail hanger 3500, similar to the rail hanger described above with respect to FIG. 20, adapted for mounting a rail 110 to a post 102. As shown in FIG. 35, the rail hanger 3500 comprises a semi-circular wrap 3502 and two ears 3504 formed and extending from the wrap 3502. Preferably two or more fasteners 3506, such as self-tapping screws, rivets, or the like, are provided for securing the rail hanger 3500 via the ears 3504 to the rail 110, and thus the rail to the post 102. While not shown, one or more fasteners may optionally be provided for further securing the rail hanger 3500 to the post 102.

FIGS. 38-40 depict one plan view and two elevation views, respectively, of one embodiment of a rail hanger 3800 adapted for mounting a rail 110 to a square post 3802, in a manner similar to that depicted in FIGS. 35-37, but for the post 3802 having a square cross-section. Accordingly, as shown in FIG. 38, the rail hanger 3800 comprises a semi-square wrap 3803 and two ears 3804 formed and extending from the wrap 3803. Preferably two or more fasteners 3806, such as self-tapping screws, rivets, or the like, are provided for securing the rail hanger 3800 via the ears 3504 to the rail 110, and thus the rail 110 to the post 3802. While not shown, one or more fasteners may optionally be provided for further securing the rail hanger 3800 to the post 3802.

Figures 41, 42, 43, 44, 45, 46, 47, 48, 49:
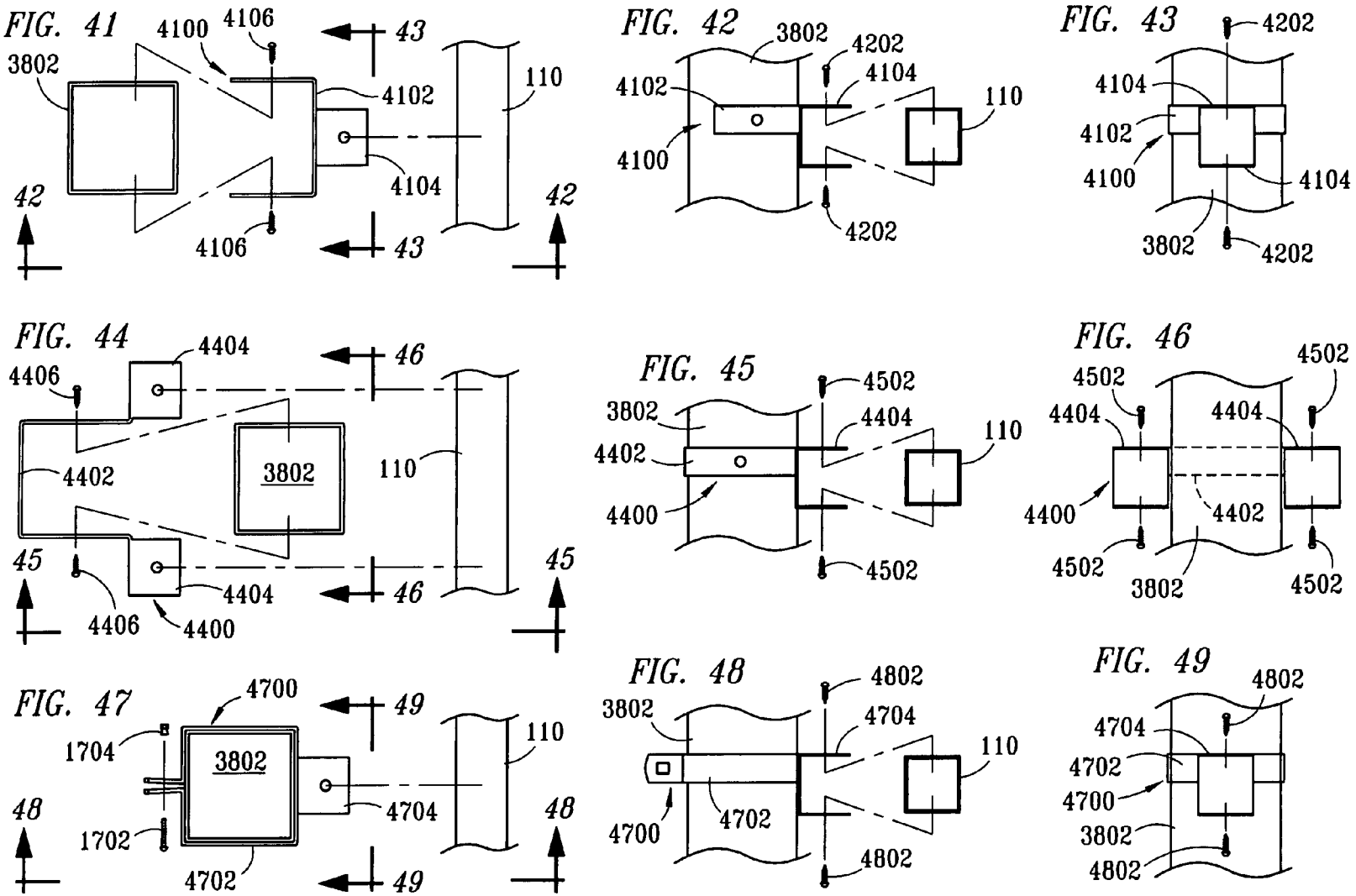
FIGS. 41-43 exemplify one plan view and two elevation views, respectively, of an alternative bracket which may be adapted for securing a rail to a post of a fence system embodying features of the present invention.
FIGS. 44-46 exemplify one plan view and two elevation views, respectively, of an alternative bracket which may be adapted for securing a rail to a post of a fence system embodying features of the present invention.
FIGS. 47-49 exemplify one plan view and two elevation views, respectively, of an alternative bracket which may be adapted for securing a rail to a post of a fence system embodying features of the present invention.

FIGS. 41-43 depict one plan view and two elevation views, respectively, of one embodiment of a rail hanger 4100 adapted for mounting a rail 110 to the square post 3802, in a manner similar to that depicted in FIGS. 32-34, but for the post 3802 having a square cross-section. Accordingly, as shown in FIG. 41, the rail hanger 4100 comprises a semi-square wrap 4102 and a bracket 4104 secured (e.g., welded) to the wrap 4102. Preferably two or more fasteners 4106, such as self-tapping screws, rivets, or the like, are provided for securing the wrap 4102 to the post 3802. As shown in FIGS. 42-43, at least two fasteners 4202, such as self-tapping screws, rivets, or the like, are preferably utilized to secure the rail 110 to the bracket 4104. It will be appreciated that two opposing fasteners 4106 or 4202 may be replaced by a single longer fastener, such as the bolt 1702 and nut 1704 described above with respect to FIG. 17.

FIGS. 44-46 depict one plan view and two elevation views, respectively, of one embodiment of a rail hanger 4400 adapted for mounting a rail 110 to the square post 3802, in a manner similar to that depicted in FIGS. 29-31, but for the post 3802 having a square cross-section. Accordingly, as shown in FIG. 44, the rail hanger 4400 comprises a semi-square wrap 4402 and two brackets 4404 secured (e.g., welded) to the wrap 4402. Preferably two or more fasteners 4406, such as self-tapping screws, rivets, or the like, are provided for securing the wrap 4402 to the post 3802. As shown in FIGS. 45-46, four or more fasteners 4502 (only two of which are depicted in FIG. 45), such as self-tapping screws, rivets, or the like, are utilized to secure the rail 110 to the bracket 4404. It will be appreciated that two opposing fasteners 4406 or 4502 may be replaced by a single longer fastener, such as the bolt 1702 and nut 1704 described above with respect to FIG. 17.

FIGS. 47-49 depict one plan view and two elevation views, respectively, of one embodiment of a rail hanger 4700 adapted for mounting a rail 110 to the square post 3802, in a manner similar to that depicted in FIGS. 26-28, but for the post 3802 having a square cross-section. Accordingly, as shown in FIG. 47, the rail hanger 4700 comprises a clamp 4702 and a bracket 4704 secured (e.g., welded) to the clamp 4702. The clamp 4702 includes a fastener, such as a bolt 1702 and nut 1704 to secure the clamp to the post 3802. As shown in FIGS. 48-49, two or more fasteners 4802, such as self-tapping screws, rivets, or the like, are preferably utilized to secure the rail 110 to the bracket 4704. It will be appreciated that two opposing fasteners 4802 may be replaced by a single longer fastener, such as the bolt 1702 and nut 1704 described above with respect to FIG. 17.

Figures 50, 51, 52, 53, 54, 55, 56, 57, 58, 59, 60:
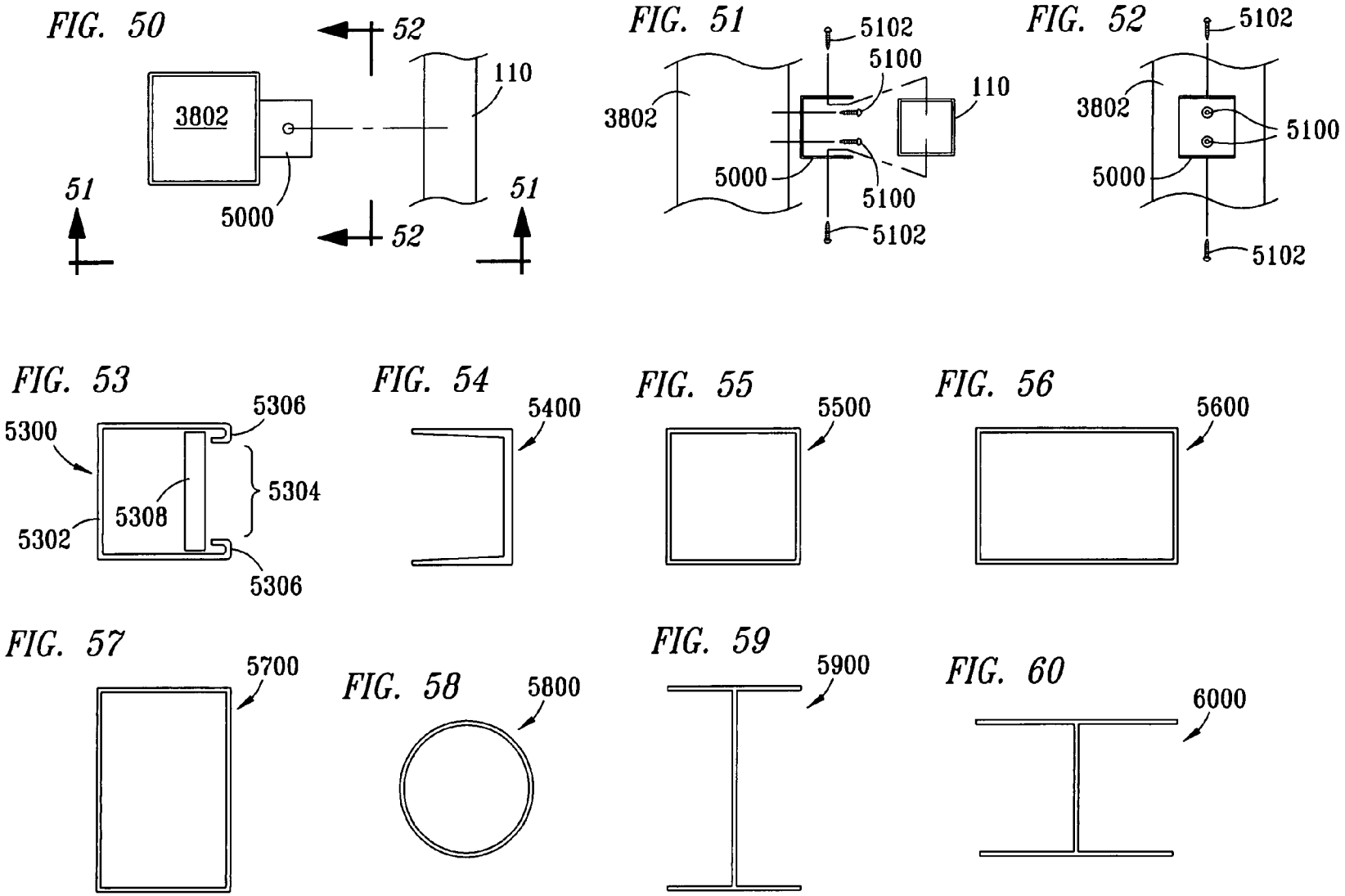
FIGS. 50-52 exemplify one plan view and two elevation views, respectively, of an alternative bracket which may be adapted for securing a rail to a post of a fence system embodying features of the present invention.
FIGS. 53-60 exemplify cross-sectional views of various alternative rails that may be utilized in a fence system embodying features of the present invention.

FIGS. 50-52 depict one plan view and two elevation views, respectively, of one embodiment of a rail hanger 5000 adapted for mounting a rail 110 to the square post 3802, in a manner similar to that depicted in FIGS. 23-25, but for the post 3802 having a square cross-section. Accordingly, as shown in FIG. 51, two or more fasteners 5100, such as self-tapping screws, rivets, or the like, are preferably utilized to secure the bracket 5000 directly to the post 3802, and two or more fasteners 5102 are preferably utilized to secure the rail 110 to the bracket 5000. It will be appreciated that two opposing fasteners 5102 may be replaced by a single longer fastener, such as the bolt 1702 and nut 1704 described above with respect to FIG. 17.

While the rail 110 may assume any of a number of different cross-sections, FIGS. 53-60 exemplify selected cross-sectional views of various rails that may be utilized with the present invention. More specifically, FIG. 53 depicts a cross-section of a rail 5300, configured using a Unistrut® metal frame, having a channel structure 5302 defining a channel opening 5304, and fabricated from a material such as metal. The structure 5302 includes edges 5306 turned inwardly and defining the channel opening 5304. A channel nut 5308 is positioned within the interior of the structure 5302, abutting the edges 5306. Use of the rail 5300 is described in further detail below with respect to FIG. 65.

FIG. 54 depicts a rail 5400 configured in the shape of a structural channel. FIG. 55 depicts a rail 5500 configured as square tubing. FIGS. 56 and 57 depict rails 5600 and 5700 configured in the shape of a substantially rectangular tubing, each rail being oriented 90° from the other. FIG. 58 depicts a rail 5800 configured in the shape of around tube or pipe. FIGS. 59 and 60 respectively depict a rail 5900 configured in the shape of a conventional I-beam, and a rail 6000 configured in the shape of a wide-flange I-beam. The rails presented herein are presented by of example, and not limitation, and rails utilized may assume any of a number of other configurations, such as, elliptical, angle iron, and the like.

Figure 61:
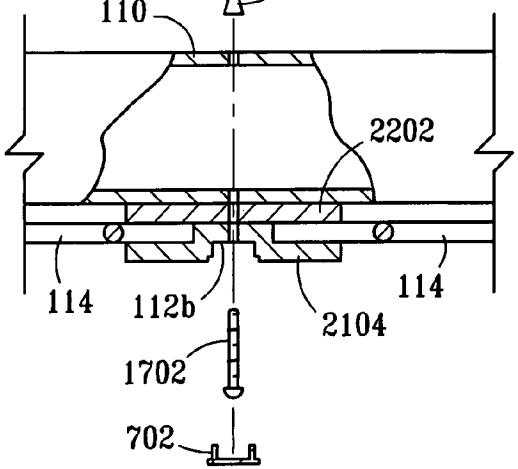

FIG. 61 depicts a plan view of an embodiment of a channel structure which is similar to the embodiment described above with respect to FIG. 22, but for further including the cover strip 702, and modifying the shaped strip 2104 to receive the cover strip 702. More specifically, as described above with respect to FIG. 22, the flat strip 2202 is positioned against the rail 110, and infill material 114 is sandwiched between the flat strip 2202 and the shaped strip 2104. The shaped strip 2104 is modified as described above with respect to FIG. 7 to define a center channel 112*b* with ratchet teeth 112*d* for matingly receiving the cover strip 702. Because the center channel 112*b* and cover strip 702 were described in some detail above with respect to FIG. 7, they will not be described in further detail herein.

Figure 62:
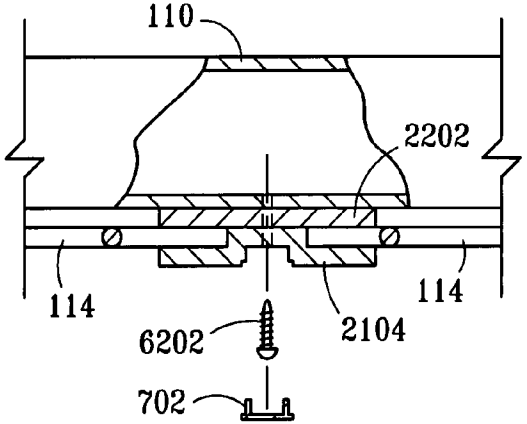
FIGS. 61 and 62 exemplify cross-sectional plan views of the union strip of FIG. 22 secured to a rail by means of fasteners with a cover positioned over the fasteners.

FIG. 62 is similar to FIG. 61, but for using a fastener 6202, such as a self-tapping screw, a rivet, or the like, in place of the bolt 1702 and nut 1704.

Figure 64:
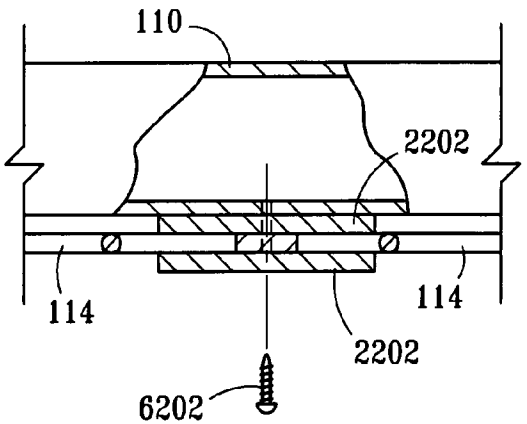
FIGS. 63 and 64 exemplify cross-sectional plan views of alternative embodiments for securing infill material directly to a rail of a fence system embodying features of the present invention.
Figure 63:
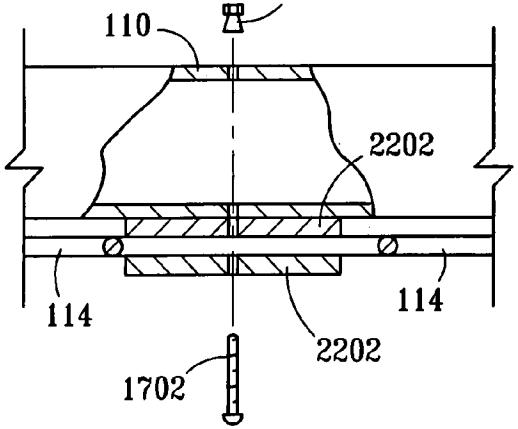

FIGS. 63 and 64 depict alternate embodiments of the channel structures described above with respect to FIGS. 61 and 62, respectively, but for replacing the shaped strip 2104 with a second flat strip 2202, and as a consequence, foregoing use of the cover strip 702.

FIGS. 65-70 are elevation views which exemplify, without limitation, a number of alternate embodiments for mounting, in accordance with principles of the present invention, a channel or flat bar for containing and retaining infill material to a rail.

Figure 65:
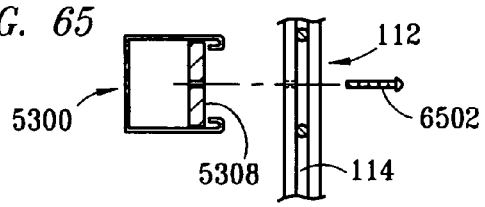
FIGS. 65-70 exemplify elevation cross-sectional views of various means for securing union strips to a rail of a fence system embodying features of the present invention.

Referring now to FIG. 65, a union strip 112 is positioned for being mounted on the Unistrut® channel rail 5300 described in further detail above with respect to FIG. 53. As shown in FIG. 65, the union strip 112 is mounted to the rail 5300 by passing a fastener 6502, such as a screwor the like, through the hole 112*b*' of the union strip 112 into the channel nut 5308 and tightening the fastener 6502. As the fastener 6502 is tightened, the channel nut 5308 maintains tension in the Unistrut® channel rail 5300, further securing the union strip 112 to the rail 5300.

Figure 66:
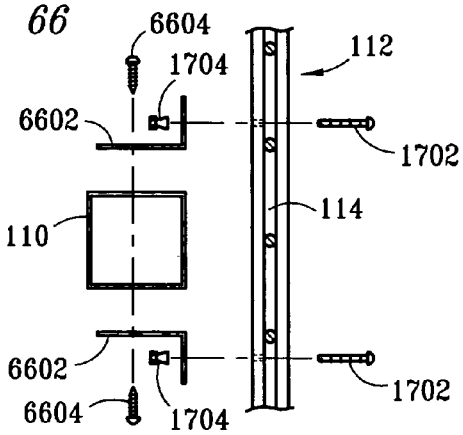

Referring now to FIG. 66, two angle brackets 6602 are mounted to the rail 110 via fasteners, such as screws, 6604. The union strip 112 is mounted to the brackets 6602, and hence to the rail 110, via fasteners, such as a bolt 1702 and nut 1704, described in further detail above with respect to FIG. 17.

Figure 67:
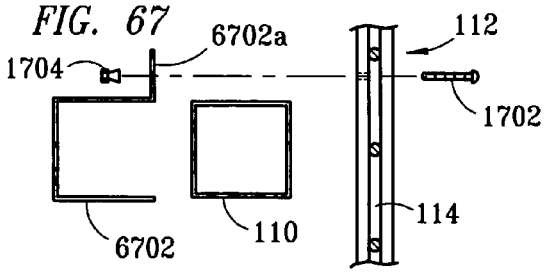

Referring now to FIG. 67, a bracket 6702 is configured to wrap the rail 110, and includes one ear 6702*a*. The union strip 112 is mounted to the ear 6702*a* of the bracket 6702, and hence to the rail 110, via fasteners, such as a bolt 1702 and nut 1704, described in further detail above with respect to FIG. 17.

Figure 68:
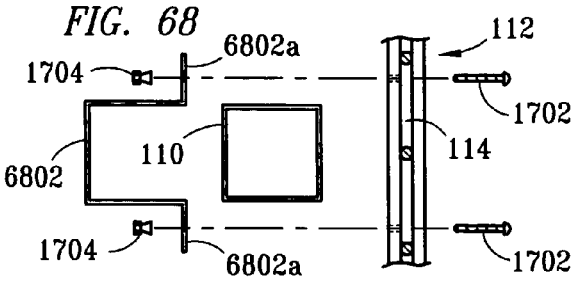

Referring now to FIG. 68, a bracket 6802 is configured to be wrap the rail 110, and includes two ears 6802*a*. The union strip 112 is mounted to the two ears 6802*a* of the bracket 6802, and hence to the rail 110, via fasteners, such as a bolt 1702 and nut 1704, described in further detail above with respect to FIG. 17.

Figure 69:
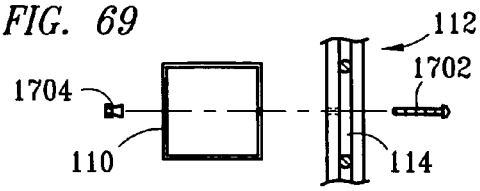

Referring now to FIG. 69, the union strip 112 is mounted directly to the rail 110 via fasteners, such as a bolt 1702 and nut 1704, described in further detail above with respect to FIG. 17.

Figure 70:
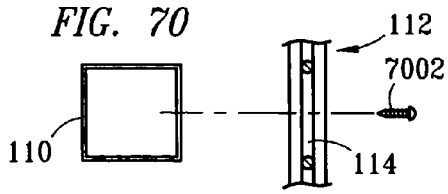

Referring now to FIG. 70, the union strip 112 is mounted directly to the rail 110 via a fastener 7002, such as a self-tapping screw, a rivet, or the like.

FIGS. 71-88 exemplify, without limitation, a number of alternate embodiments of clips for preferably further securing, in accordance with principles of the present invention, infill material 114 directly to a rail 110, 1200, 5300, or the like, intermediate to the channel strips 112.

Figure 71:
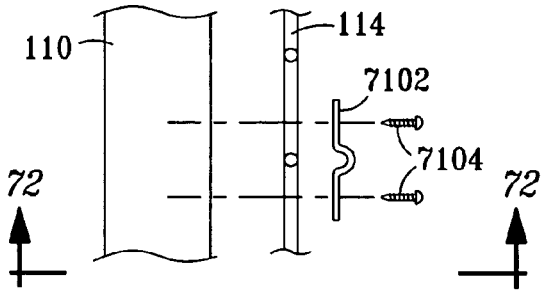
FIGS. 71-72 exemplify a plan view and a cross-sectional elevation view, respectively, of a bracket which may be adapted for securing infill wire mesh to a rail of a fence system embodying features of the present invention.
Figure 72:
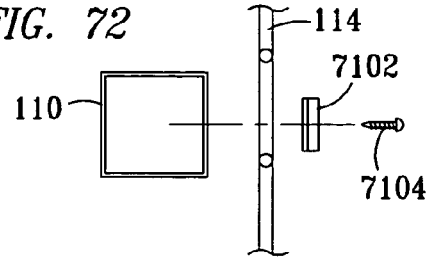

Referring now to FIGS. 71-72, a bracket 7102 is positioned over a portion (e.g., a wire) of infill material 114. Fasteners 7104, such as self-tapping screws, rivets, or the like, are provided for securing each end of the bracket 7102 to the rail 110, thereby securing the infill material 114 to the rail 110.

Figure 73:
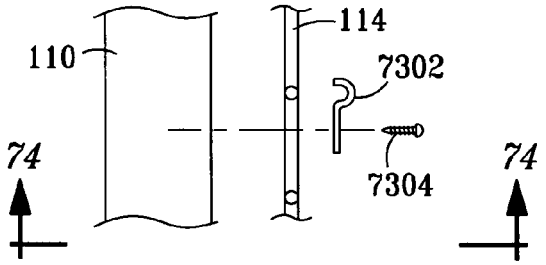
FIGS. 73-74 exemplify a plan view and a cross-sectional elevation view, respectively, of an alternative bracket which may be adapted for securing infill wire mesh to a rail of a fence system embodying features of the present invention.
Figure 74:
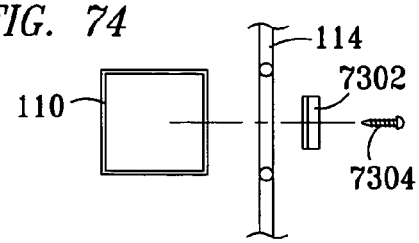

Referring now to FIGS. 73-74, a bracket 7302 is positioned over a portion (e.g., a wire) of infill material 114. A fastener 7304, such as a self-tapping screw, a rivet, or the like, is provided for securing one end of the bracket 7302 to the rail 110, thereby securing the infill material 114 to the rail 110.

Figure 75:
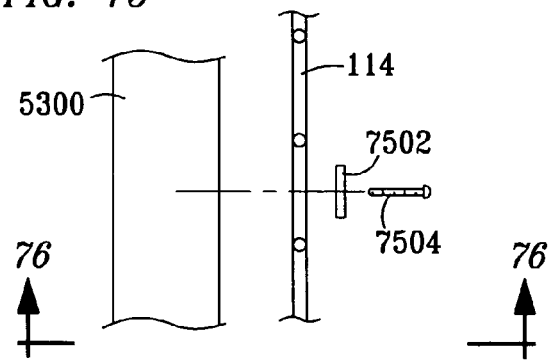
FIGS. 75-76 exemplify a plan view and a cross-sectional elevation view, respectively, of an alternative bracket which may be adapted for securing infill wire mesh to a rail of a fence system embodying features of the present invention.
Figure 76:
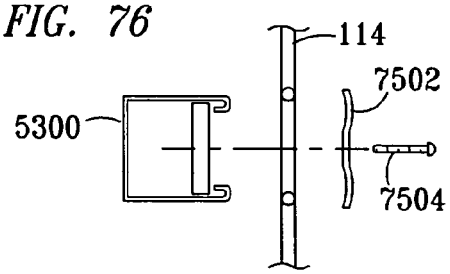

Referring now to FIGS. 75-76, a bracket 7502 is positioned over a portion (e.g., two wires) of infill material 114. A fastener 7504, such as a self-tapping screw, a rivet, or the like, is provided for securing a central portion of the bracket 7502 to a Unistrut® rail 5300, thereby securing the infill material 114 to the rail 5300.

Figure 77:
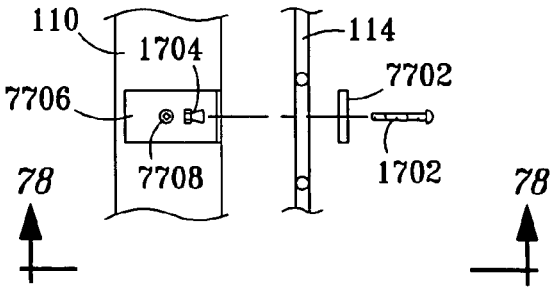
FIGS. 77-78 exemplify a plan view and a cross-sectional elevation view, respectively, of an alternative bracket which may be adapted for securing infill wire mesh to a rail of a fence system embodying features of the present invention.
Figure 78:
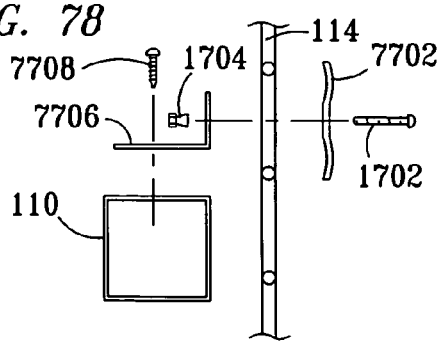

Referring now to FIGS. 77-78, an angle bracket 7706 is mounted on the rail 110 in any conventional manner, using, by way of example, one or more fasteners 7708 (e.g., a self-tapping screw or rivet). A bracket 7702 is positioned over a portion (e.g., two wires) of infill material 114. A fastener, such as a bolt 1702 and nut 1704 described above with respect to FIG. 17, is provided for securing a central portion of the bracket 7702 to the angle bracket 7706, thereby securing the infill material 114 to the rail 110.

Figure 79:
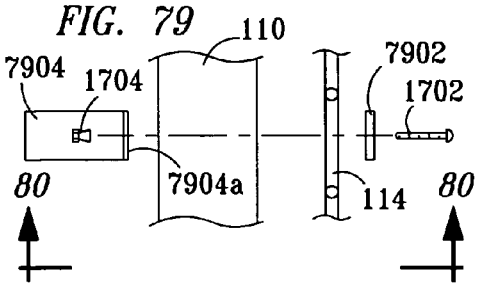
FIGS. 79-80 exemplify a plan view and a cross-sectional elevation view, respectively, of an alternative bracket which may be adapted for securing infill wire mesh to a rail of a fence system embodying features of the present invention.
Figure 80:
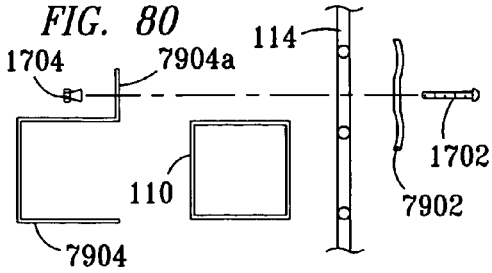

Referring now to FIGS. 79-80, a channel-shaped bracket 7904 having an ear 7904*a* is configured for fitting on the rail 110. A bracket 7902 is positioned over a portion (e.g., two wires) of infill material 114. A fastener, such as a bolt 1702 and nut 1704 described above with respect to FIG. 17, is provided for securing a central portion of the bracket 7902 to the ear 7904*a* of the bracket 7904, thereby securing the infill material 114 to the rail 110.

Figure 81:
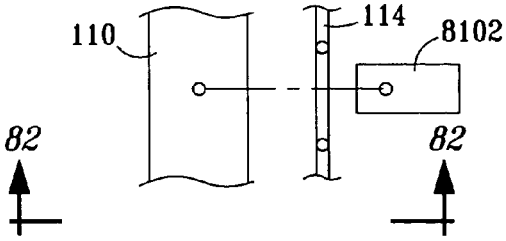
FIGS. 81-82 exemplify a plan view and a cross-sectional elevation view, respectively, of an alternative bracket which may be adapted for securing infill wire mesh to a rail of a fence system embodying features of the present invention.
Figure 82:
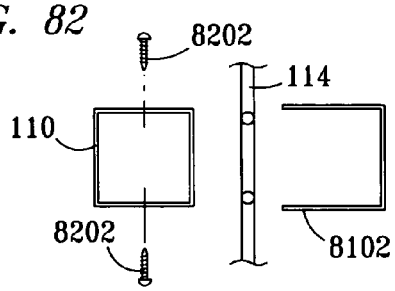

Referring now to FIGS. 81-82, a channel-shaped bracket 8102, also discussed above, e.g., with respect to FIGS. 1, 2, and 14, is sized for fitting on the rail 110. The bracket 8102 is positioned over a portion (e.g., one or two wires) of infill material 114, and then fitted over the rail 110. Two or more fasteners, such as self-tapping screws, rivets, or the like, are provided for securing the bracket 8102, and hence the infill material 114, to the rail 110.

Figure 83:
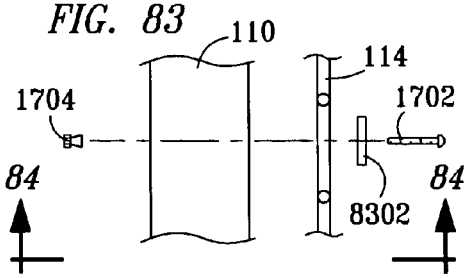
FIGS. 83-84 exemplify a plan view and a cross-sectional elevation view, respectively, of an alternative bracket which may be adapted for securing infill wire mesh to a rail of a fence system embodying features of the present invention.
Figure 84:
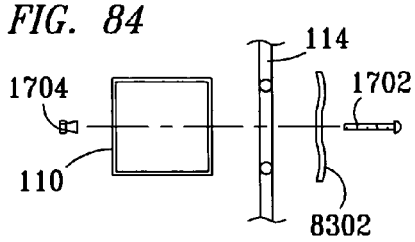

Referring now to FIGS. 83-84, a bracket 8302 is positioned over a portion (e.g., two wires) of infill material 114. A fastener, such as a bolt 1702 and nut 1704 described above with respect to FIG. 17, is provided for securing a central portion of the bracket 8302 to the rail 110, thereby securing the infill material 114 to the rail 110.

Figure 85:
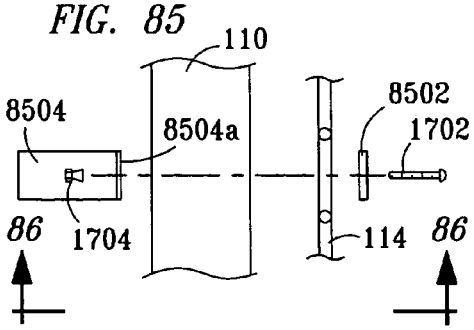
FIGS. 85-86 exemplify a plan view and a cross-sectional elevation view, respectively, of an alternative bracket which may be adapted for securing infill wire mesh to a rail of a fence system embodying features of the present invention.
Figure 86:
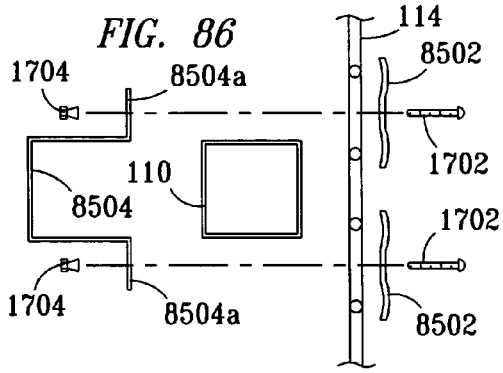

Referring now to FIGS. 85-86, a channel-shaped bracket 8504 having two ears 8504*a* is configured for fitting on the rail 110. Two brackets 8502 are positioned over a portion (e.g., two wires each) of infill material 114. A fastener, such as a bolt 1702 and nut 1704 described above with respect to FIG. 17, is provided for securing a central portion of each bracket 8502 to the ear 8504*a* of the bracket 8504, thereby securing the infill material 114 to the rail 110.

Figure 87:
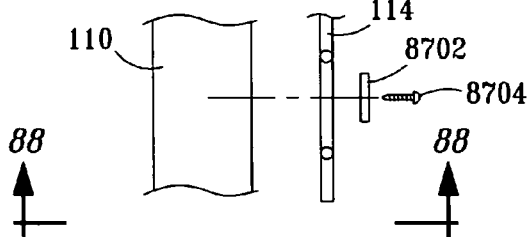
FIGS. 87-88 exemplify a plan view and a cross-sectional elevation view, respectively, of an alternative bracket which may be adapted for securing infill wire mesh to a rail of a fence system embodying features of the present invention.
Figure 88:
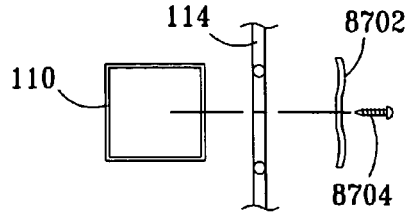

Referring now to FIGS. 87-88, a bracket 8702 is positioned over a portion (e.g., two wires) of infill material 114. A fastener 8704, such as a self-tapping screw, a rivet, or the like, is provided for securing a central portion of the bracket 8702 to the rail 110, thereby securing the infill material 114 to the rail 110.

Figure 89:
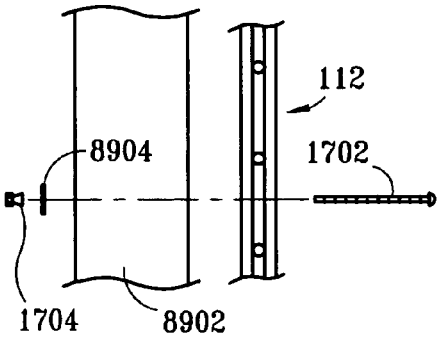
FIGS. 89-90 exemplify elevation views of two embodiments for mounting a union strip and infill material of a fence system embodying features of the present invention to a wall rather than posts.
Figure 90:
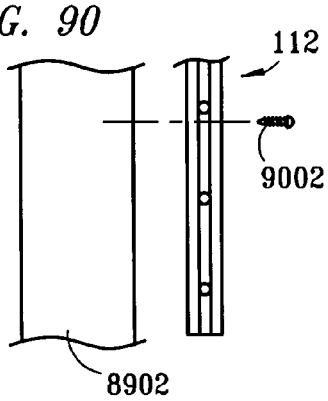

FIGS. 89-90 are elevation views which exemplify, without limitation, two alternate embodiments for mounting union strips 112, without rails, to a wall 8902, such as a concrete wall, a mortar wall, brick wall, or the like, rather than posts, in accordance with principles of the present invention. With specific reference to FIG. 89, a carriage head bolt 1702 is extended through a hole 112*b*' of a union strip 112 and through the wall 8902 and tightened onto a breakaway nut 1704, preferably with a washer 8904 positioned between the wall 8902 and the nut 1704. In FIG. 90, a fastener 9002, such as a self-tapping screw, a rivet, or the like, is extended through a hole 112*b*' of a union strip 112 and threaded or secured in the wall 8902. While not shown, in a further embodiment, the union strips 112 may be secured to the wall 8902 with a suitable adhesive, or adhesive may be used in conjunction with the embodiment depicted by FIGS. 89 or 90 above.

FIGS. 91-94 are elevation views which exemplify, without limitation, four alternate embodiments for mounting rails 110 to the wall 8902 described above, in accordance with principles of the present invention.

Figure 91:
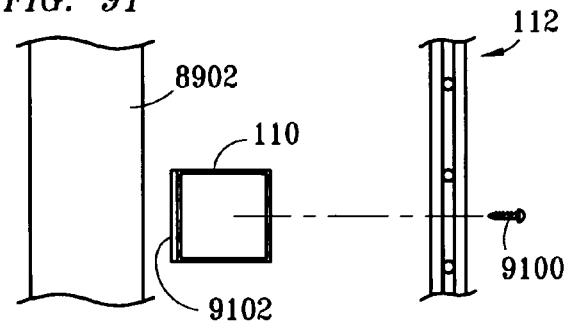
FIGS. 91-94 exemplify elevation views of four embodiments for mounting a rail, union strip, and infill material of a fence system embodying features of the present invention to a wall rather than posts.

With specific reference to FIG. 91, a rail 110 is secured to the wall 8902 using any suitable adhesive 9102 effective for adhering the rail to the wall, e.g., for adhering metal to concrete. The union strip 112 is secured to the rail 110 via one or more fasteners 9100, such as self-tapping screws, rivets, or the like. Alternatively, the union strip 112 may be secured to the rail 110 using any of a number of different techniques, such as exemplified in FIGS. 65-70 described above.

Figure 92:
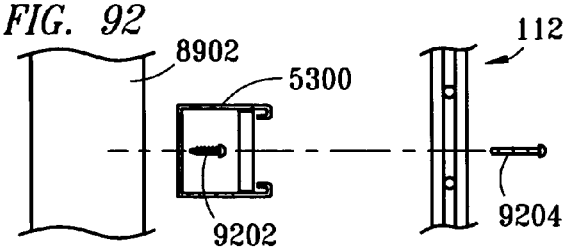

Referring to FIG. 92, a Unistrut® rail 5300 is secured to the wall via one or more fasteners 9202, such as, for example, self-tapping screws, or the like. A union strip 112 is secured to the rail 5300 via a fastener 9204 as described above with respect to FIG. 65.

Figure 93:
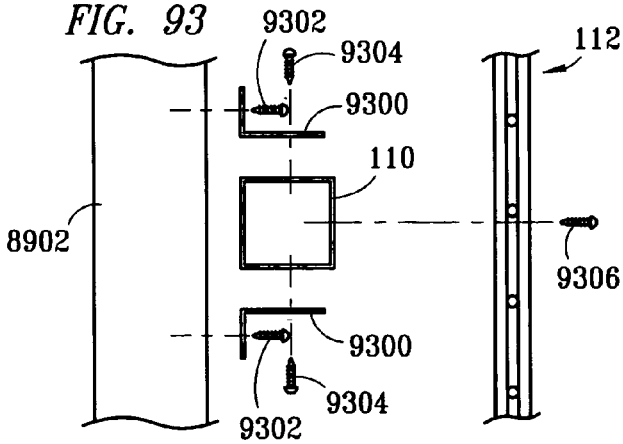

Referring to FIG. 93, upper and a lower angle. brackets 9300 are positioned above and below the rail 110 and secured thereto with one or more fasteners 9304, such as, for example, self-tapping screws, rivets, or the like. The brackets 9300 are then secured to the wall 8902 via one or more fasteners 9302, such as, for example, self-tapping screws, or the like. The union strip 112 is secured to the rail 110 via one or more fasteners 9306, such as self-tapping screws, rivets, or the like. Alternatively, the union strip 112 may be secured to the rail 110 using any of a number of different techniques, such as exemplified in FIGS. 65-70 described above.

Figure 94:
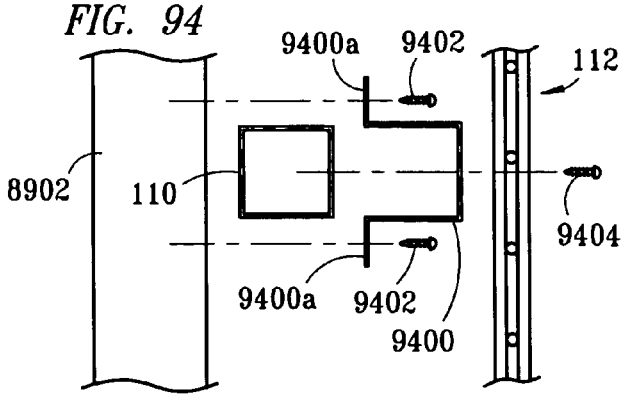

Referring to FIG. 94, a channel-shaped bracket 9400 having upper and lower ears 9400*a* is sized for fitting about the rail 110. Two or more fasteners, such as self-tapping screws, or the like, are provided for securing the ears 9400*a* of the bracket 9400, and hence the rail 110, to the wall 8902. The union strip 112 is secured to the rail 110 via one or more fasteners 9404, such as self-tapping screws, rivets, or the like. Alternatively, the union strip 112 may be secured to the rail 110 using any of a number of different techniques, such as exemplified in FIGS. 65-70 described above.

Figure 95:
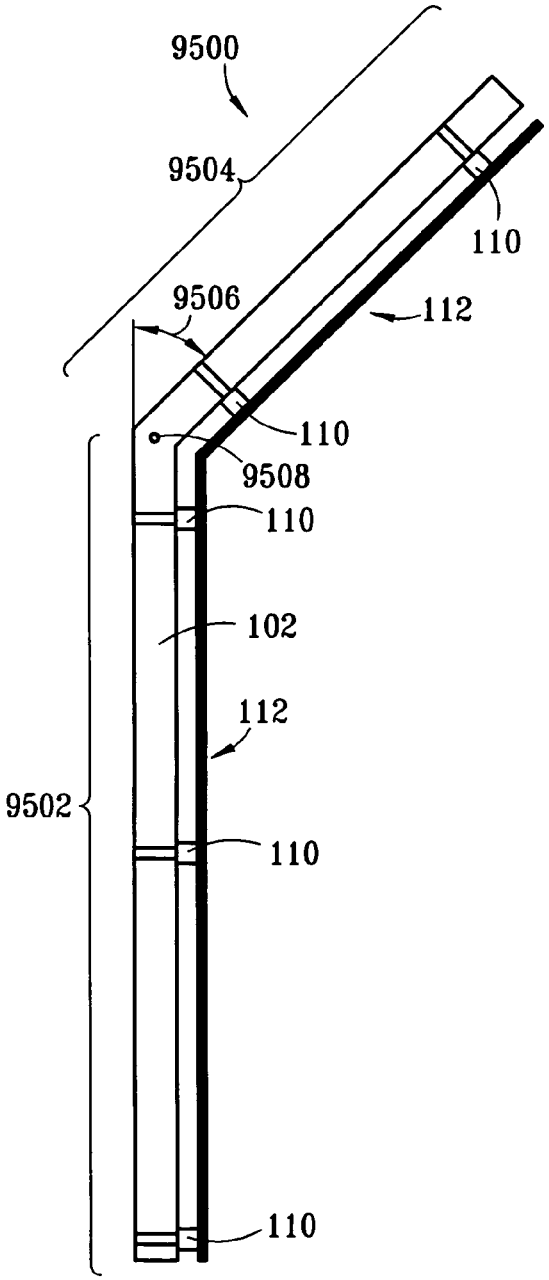
FIGS. 95-96 exemplify side and front elevation views, respectively, of a canted fence system embodying features of the present invention.
Figure 96:
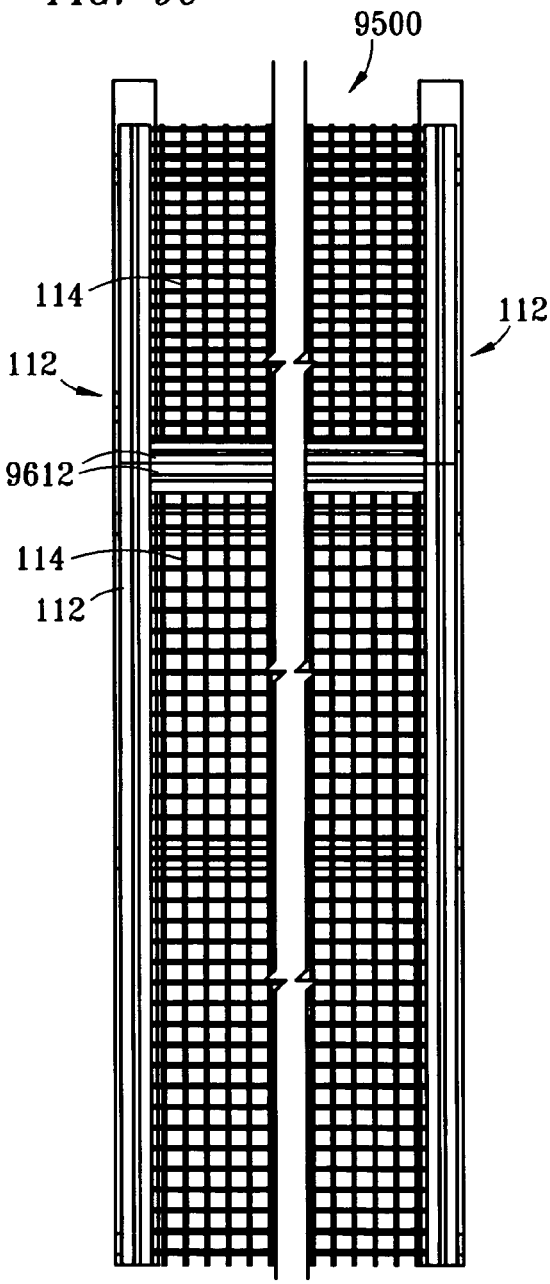

FIGS. 95 and 96 exemplify side and frontal elevation views, respectfully, of a canted fence system 9500 embodying features of the present invention. As shown in FIG. 95, the fence system 9500 includes a vertical portion 9502 and a canted portion 9504. The vertical portion 9502 is substantially similar to the embodiments of the fence system 100 described above with respect to FIGS. 1-94, and the canted portion 9504 is substantially similar to the vertical portion 9502, but for being canted at an angle 9506, such as 45°, though the angle may vary as desired between 1° and 90°. The post 102 is canted at the vertex 9508 in any conventional manner; for example, two straight posts may be welded together, or connected together via a post bend connected to each post, or an extended post 102 may be bent at the vertex 9508. Furthermore, to secure the vertex 9508, two union strips 9612, similar to the union strips 112, are preferably positioned to abut one another and receive the vertical and canted portions of infill material 114. Alternatively, the infill material may be bent at the vertex, or a corner strip, similar to the corner strip 800 (FIG. 8) may be positioned at the vertex.

The rails 110 and union strips 112 are mounted to the posts 102 as described above with respect to FIGS. 1-94. While not shown, in alternative embodiments, one or more additional canted portions, similar to the canted portion 9504 but canted at a different angle, may be extended from the canted portion 9504. In a further embodiment, the canted portion 9504 may be curvilinear, and/or an additional canted portion 9504 may be mirrored, to thereby form a "Y", as viewed in FIG. 95. Still further, barbed wire or Constantina wire may be positioned atop the fence system 9500, as discussed above with respect to FIG. 16.

Figure 97:
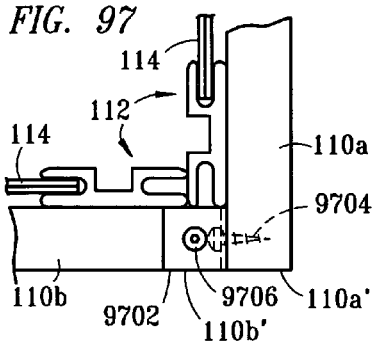
FIG. 97 exemplifies one embodiment for connecting together two rails to form an interior corner of a fence system embodying features of the present invention.

FIG. 97 is a plan view which exemplifies one embodiment for conjoining together a first rail 110*a* to a second rail 110*b* at a corner of a fence system embodying features of the present invention, similarly as discussed above with respect to FIG. 10. Accordingly, as viewed in FIG. 97, a channel-shaped bracket 9702 is positioned proximate to an end 110*a*' of the first rail 110*a*, and a fastener, such as a self-tapping screw 9704, is then extended through a hole (not shown) formed in the bracket 9702 and into the end 110*a*' of the first rail 110*a* to secure the bracket 9702 to the rail 110*a*. The end 110*b*' of the second rail 110*b* is then secured to the bracket 9702 in any conventional manner, such as by fasteners, such as a self-tapping screw, bolt, or the like, or via welding, or the like. As depicted in FIG. 10, union strips 112 positioned on the interior of the fence corner preferably abut one another to maximize the security of the fence system.

Figure 98:
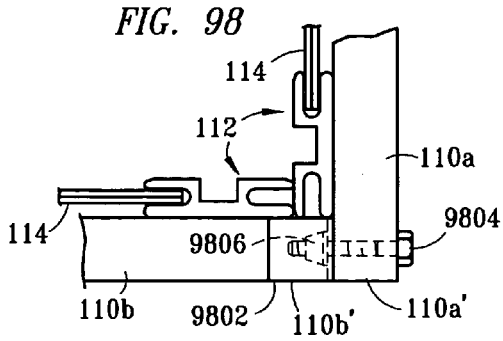
FIG. 98 exemplifies an alternate embodiment for connecting together two rails to form an interior corner of a fence system embodying features of the present invention.

FIG. 98 is a plan view which exemplifies an alternate embodiment for conjoining together a first rail 110*a* to a second rail 110*b* at a corner of a fence system, similarly as discussed above with respect to FIG. 97, but for using a fastener 9804, such as a bolt 1702 and nut 1704, which extends through the entire rail 110*a*.

Figure 99:
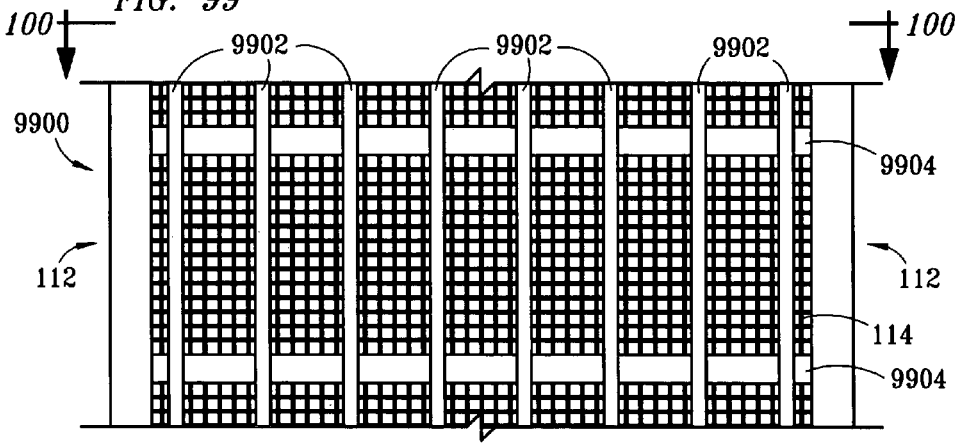
FIG. 99 exemplifies an elevation view of a fence system having pickets in accordance with principles of the present invention.
Figure 100:
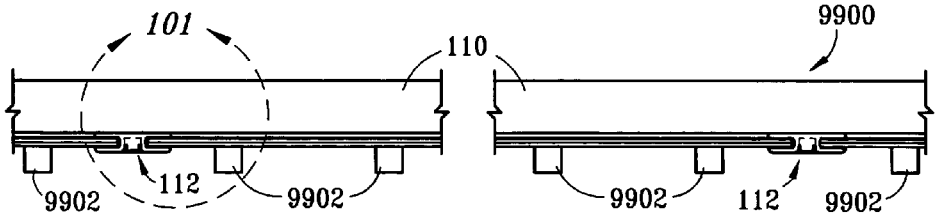
FIG. 100 depicts a plan view of the picket fence system of FIG. 99.
Figure 101:
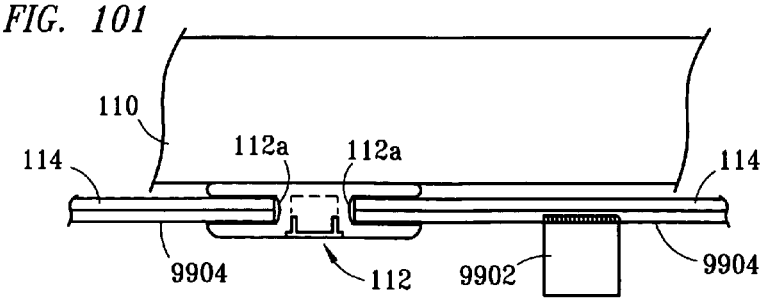
FIG. 101 depicts a detail portion of the fence system of FIG. 100.

FIGS. 99-101 exemplify one embodiment providing for pickets on a picket fence system 9900 in accordance with principles of the present invention, as may be desired by retail garden centers for not only enhancing security, but also providing a degree of ornamentation. With reference to FIG. 99, preferably two or more flat plates 9904 are positioned horizontally between two union strips 112 across infill material 114, and pickets 9902 are mounted (e.g., welded) on the flat plates 9904. FIG. 100, taken along the line 100-100 of FIG. 99, shows a plan view of the picket fence 9900. FIG. 101 depicts detail of a portion of the picket fence 9900 within the line 101 of FIG. 100. More specifically, as shown in FIG. 101, both the infill material 114 and the flat plates 9904 are positioned and secured within the channels 112*a* of the union strip 112.

Figure 102:
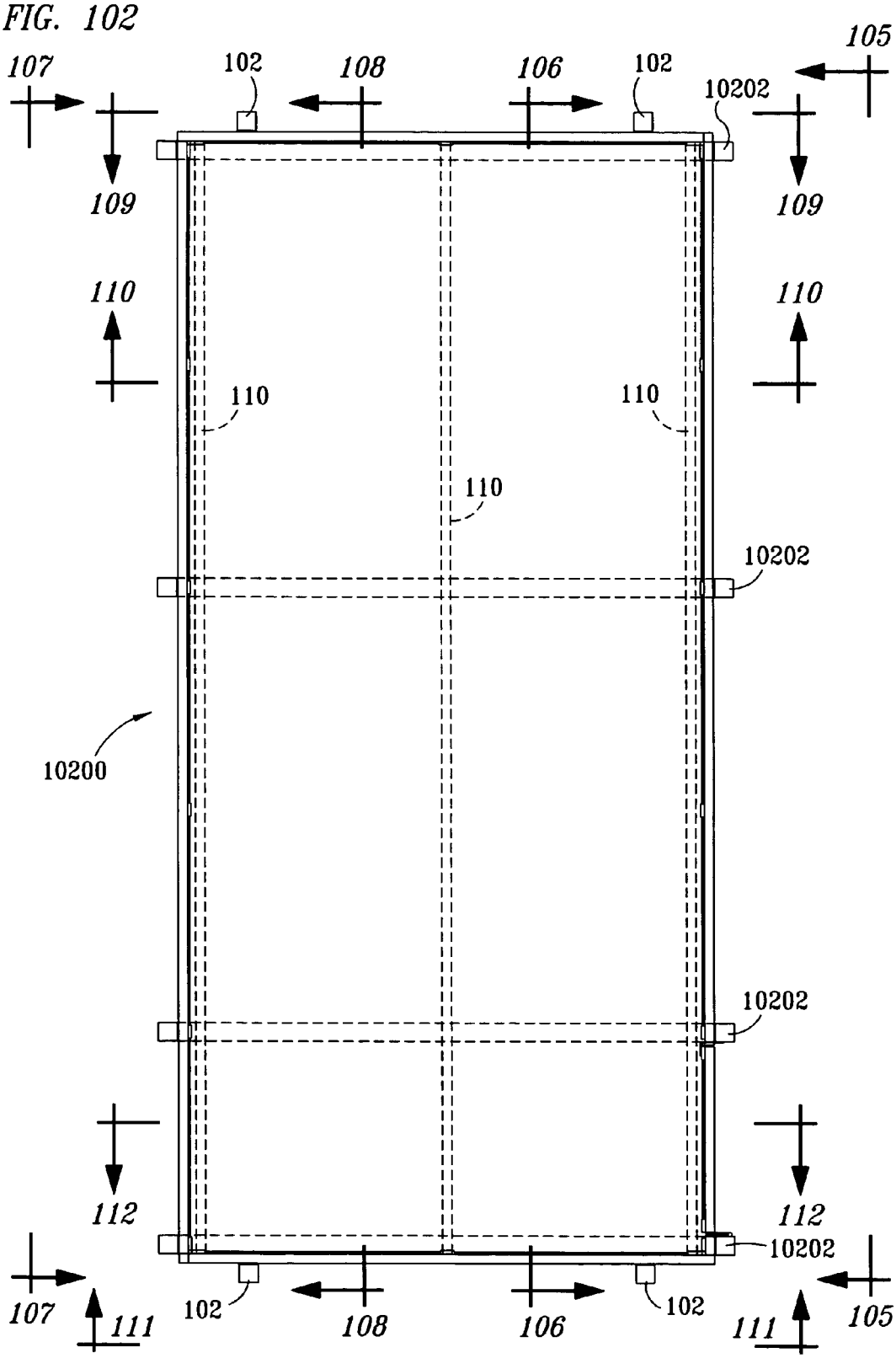
FIG. 102 exemplifies a site plan of a first embodiment of a fence system configured as an enclosure having infill material positioned on the interior of the enclosure and extending across the top of the enclosure in accordance with principles of the present invention.
Figure 103:
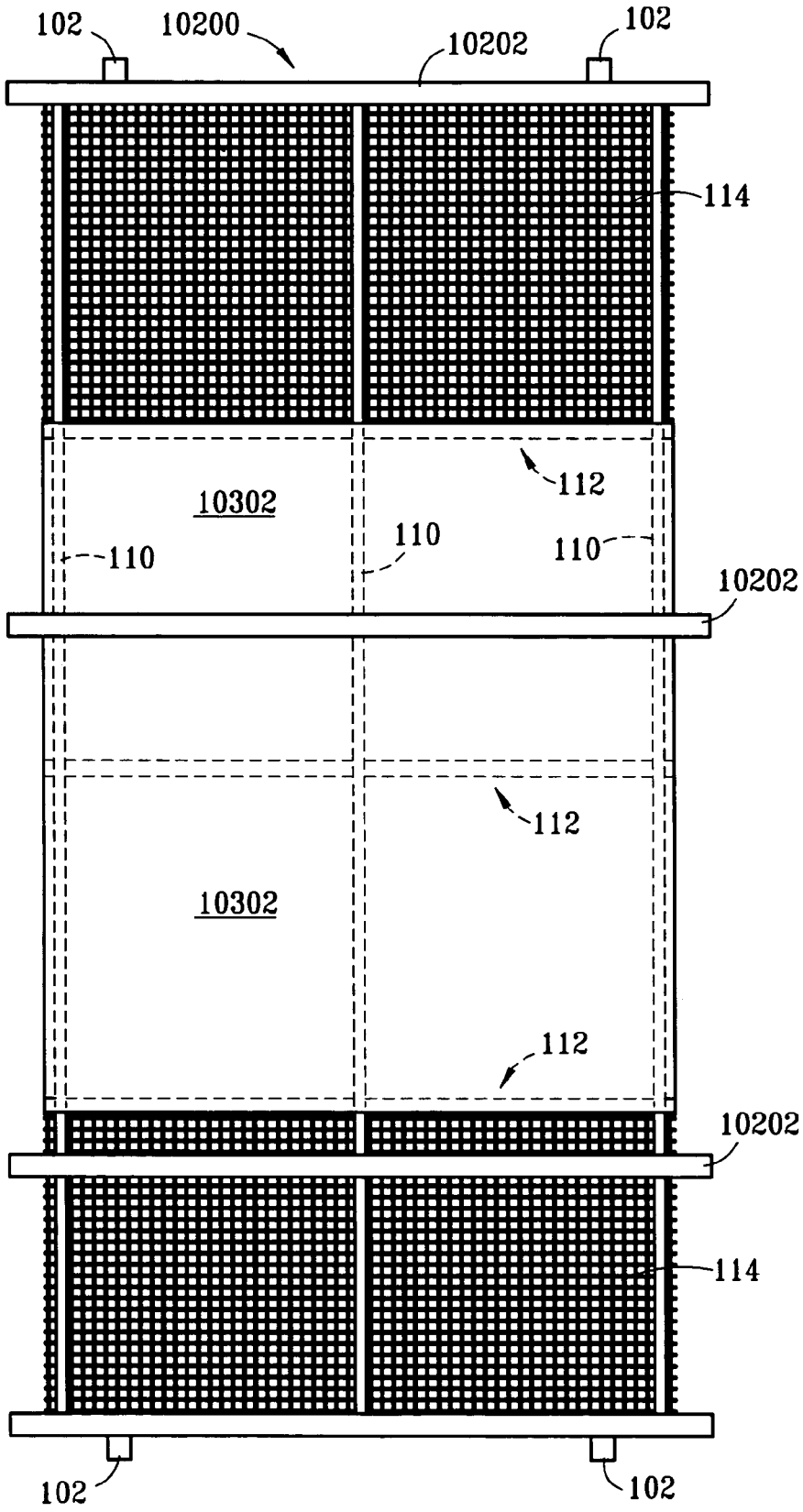
FIG. 103 presents a plan view of the fence system of FIG. 102.
Figure 104:
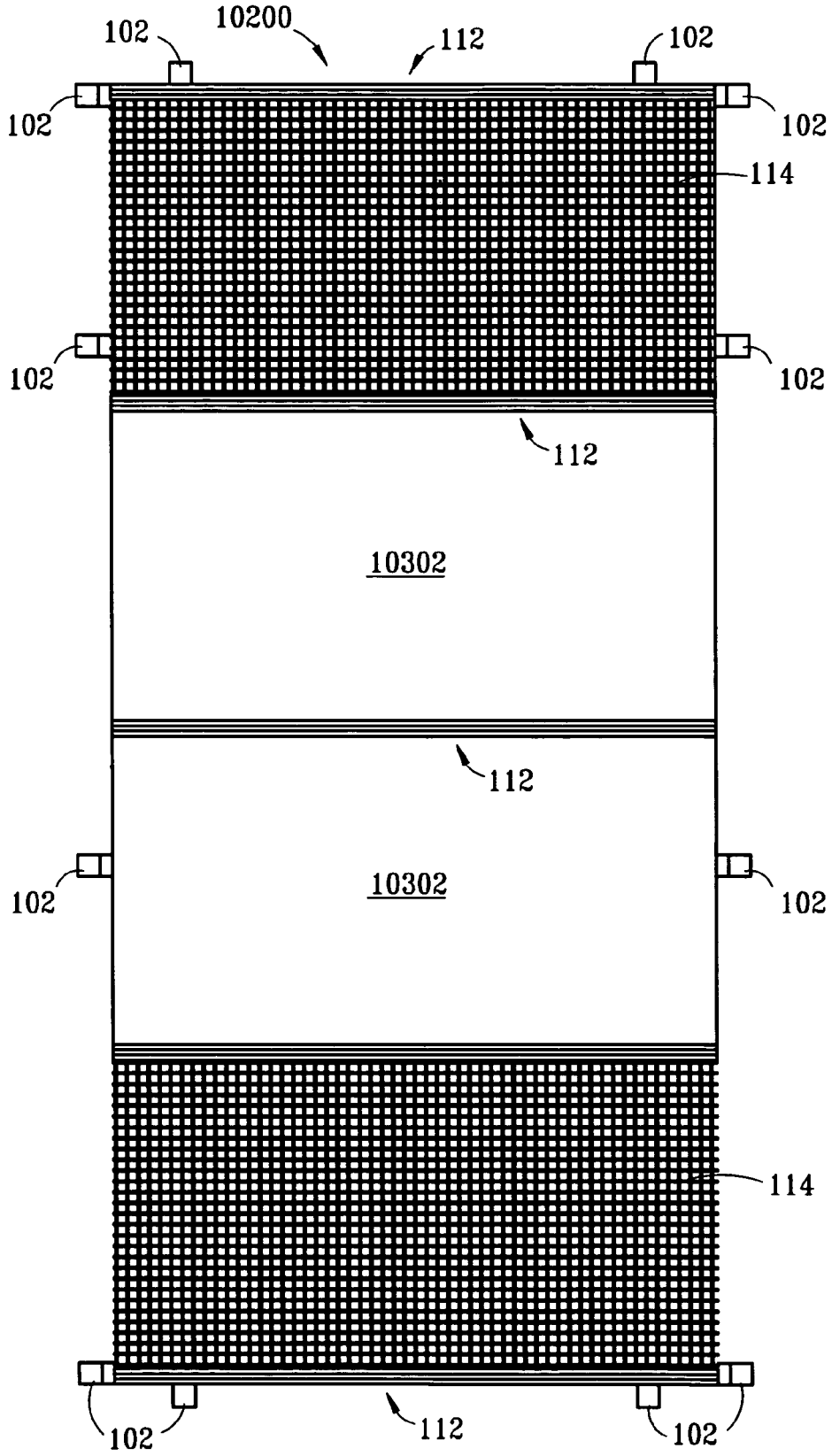
FIG. 104 presents a bottom view of the fence system of FIG. 102.

FIGS. 102-114 exemplify various views of an enclosure 10200 configured in accordance with principles of the present invention, for preventing persons on the inside from getting out, as in an exercise pen in a correctional institution. Referring to FIG. 102, a site plan view is shown of an overall structure for the enclosure 10200. As shown, the enclosure 10200 defines a structure having twelve posts 102 and four rafters 10202 (shown in dashed outline) extending between eight of the posts 102, though more or less posts and rafters may be utilized as suitable or desirable. Three rails 110 (shown in dashed outline, it being understood that more or less rails may be utilized as desired), extend perpendicularly across the rafters 10202. As shown more clearly in FIGS. 103 and 104, viewed as a plan view from above and below, respectively, union strips 112 extend perpendicularly across the rails 110. Infill material 114 and a solid sheet of material (e.g., aluminum or the like) 10302 extends between, and is retained by, union strips 112, and is preferably further retained to the rails 110 by clips, such as clips 8102, to thereby secure the top of the enclosure 10200.

Figure 105:
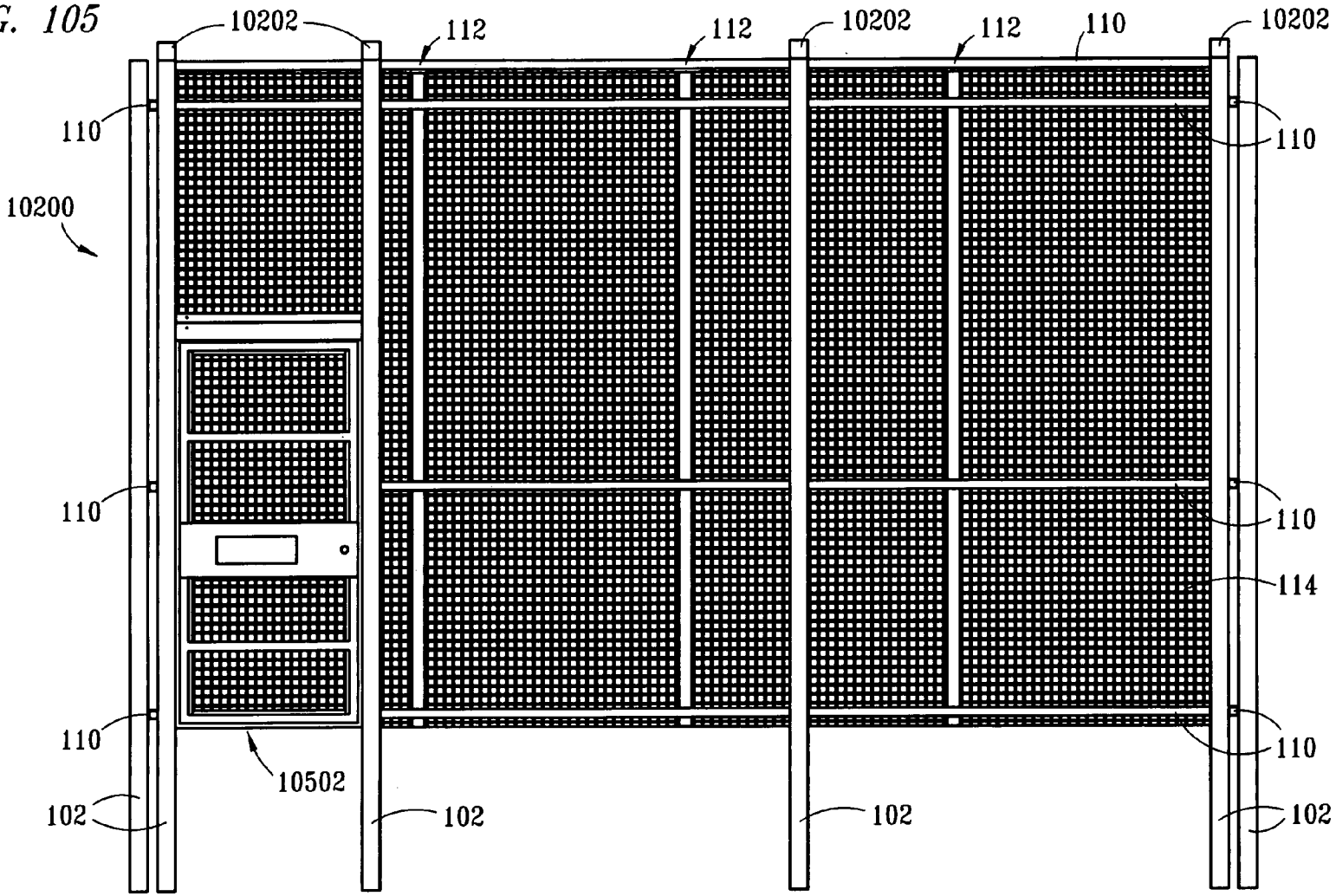
FIG. 105 presents an elevation view of the fence system of FIG. 102 taken along the line 105-105 of FIG. 102.
Figure 106:
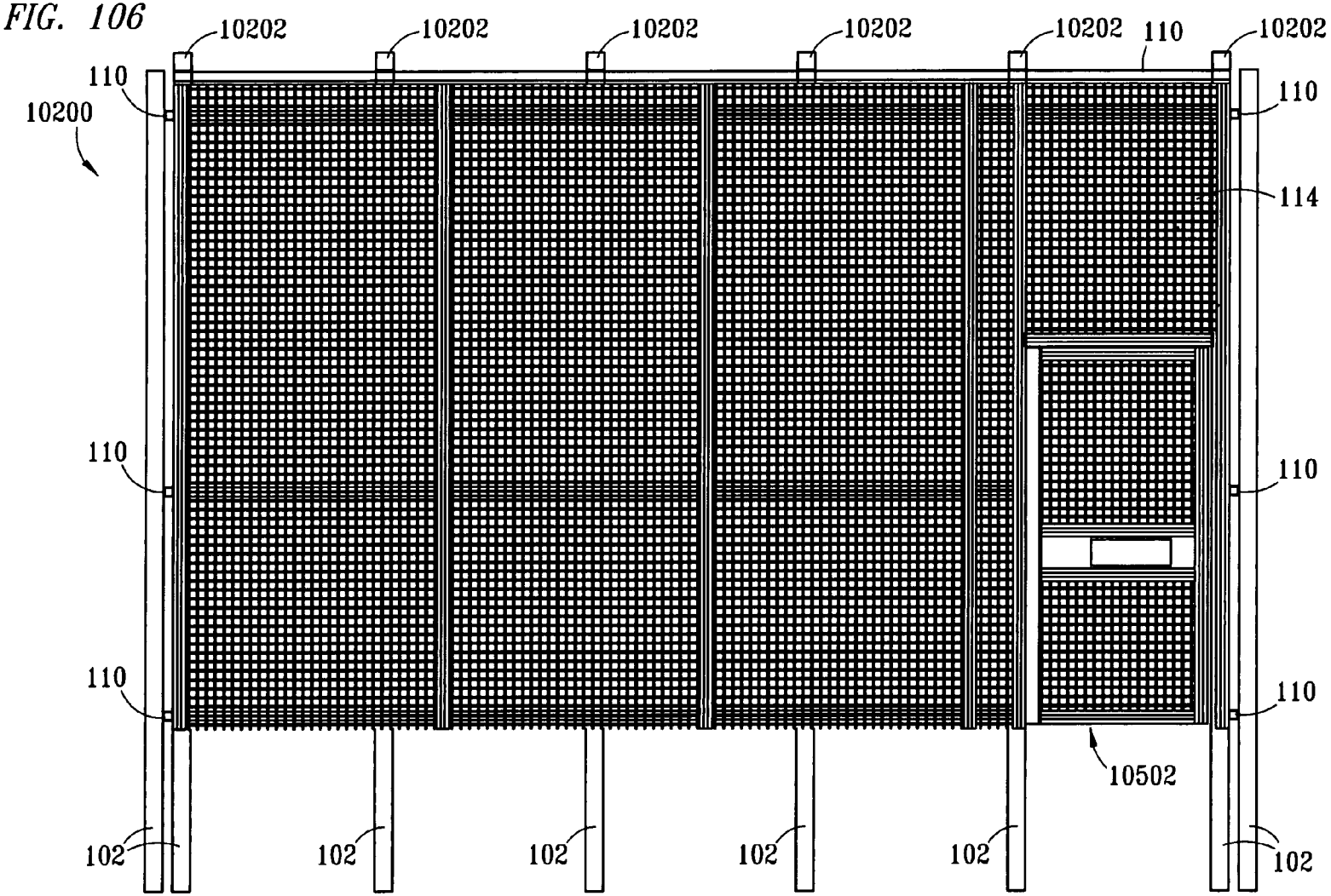
FIG. 106 presents an elevation view of the fence system of FIG. 102 taken along the line 106-106 of FIG. 102.

FIGS. 105 and 106 depict one side of the enclosure 10200, viewed from the exterior and interior sides of the enclosure, respectively. As shown therein, the enclosure 10200 is preferably provided with a gate 10502, discussed in further detail below with respect to FIG. 113. It is noted that posts 102 extend below the lower edge of the infill material 114 for being embedded in ground or a concrete slab.

Figure 107:
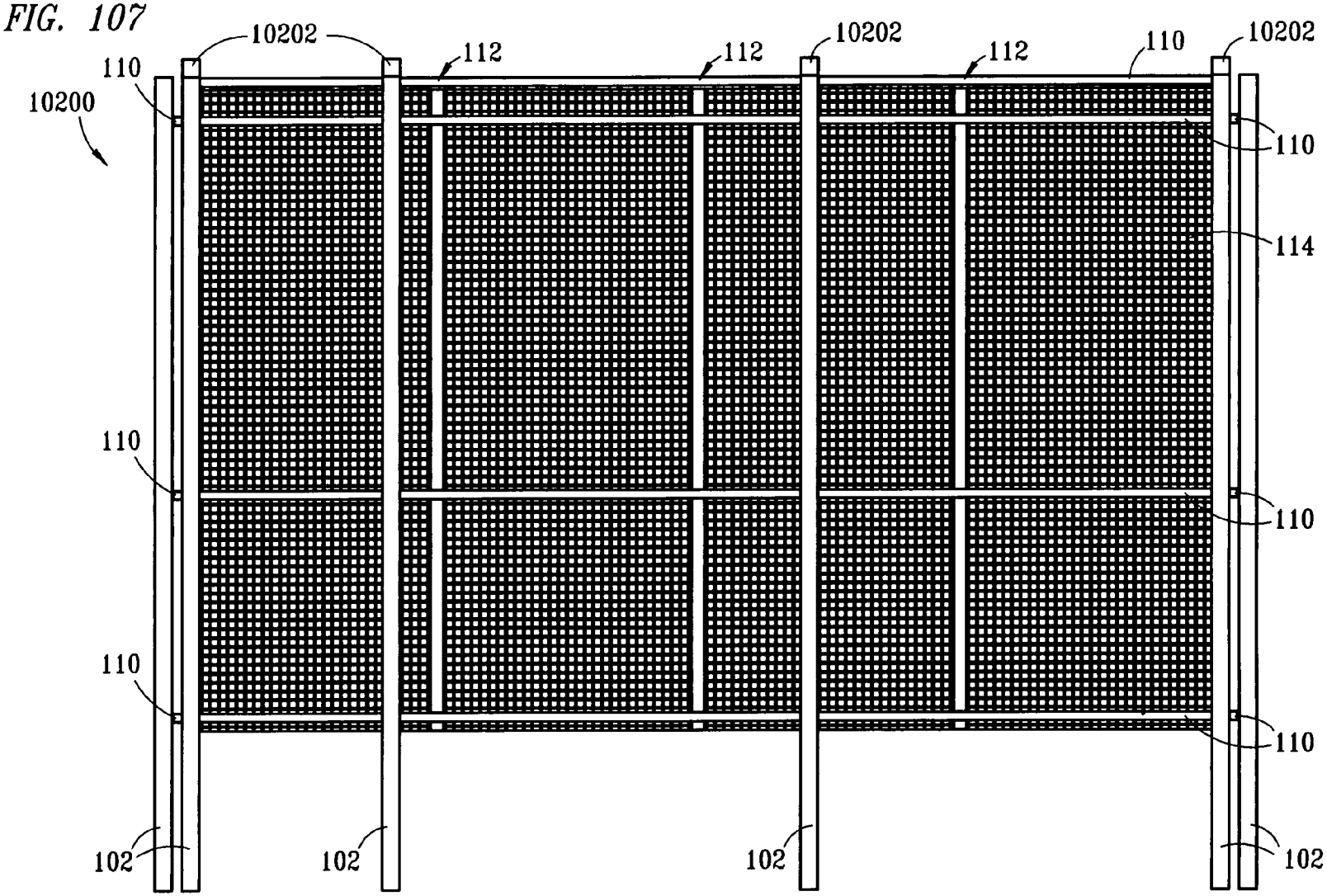
FIG. 107 presents an elevation view of the fence system of FIG. 102 taken along the line 107-107of FIG. 102.
Figure 108:
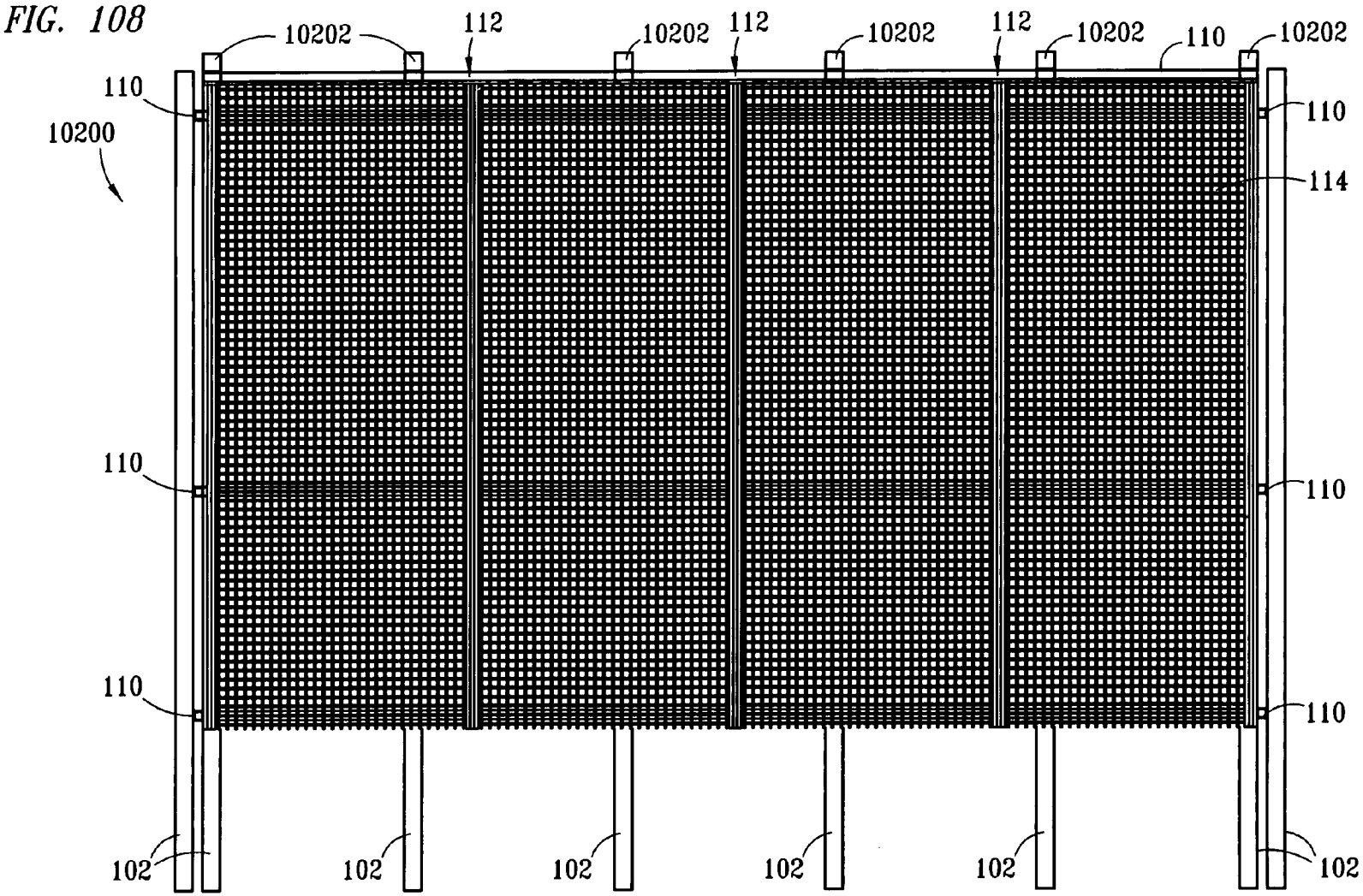
FIG. 108 presents an elevation view of the fence system of FIG. 102 taken along the line 108-108 of FIG. 102.

FIGS. 107 and 108 depict a side of the enclosure 10200 opposite the side depicted in FIGS. 105 and 106, viewed from the exterior and interior sides of the enclosure, respectively.

Figure 109:
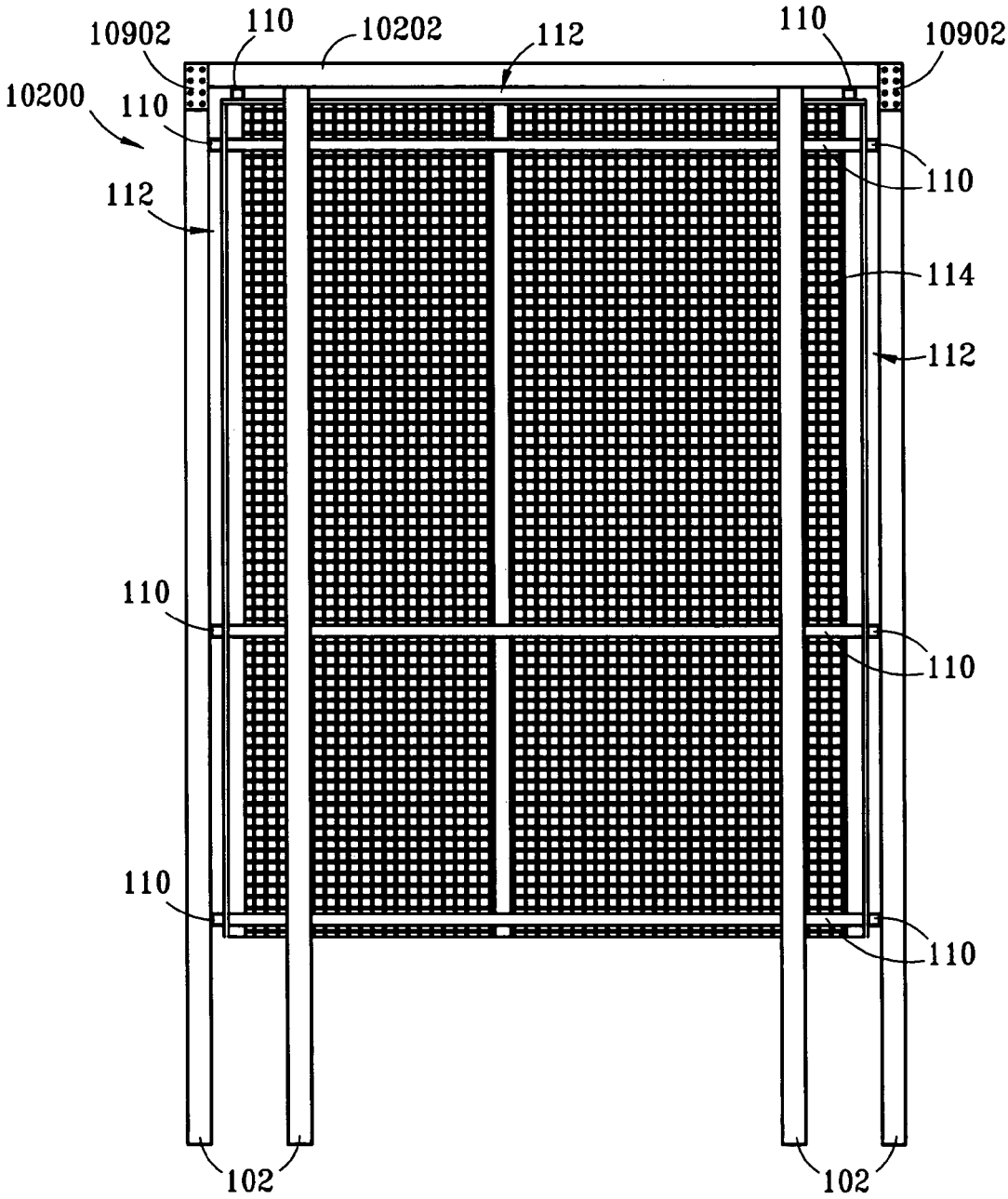
FIG. 109 presents an elevation view of the fence system of FIG. 102 taken along the line 109-109 of FIG. 102.
Figure 110:
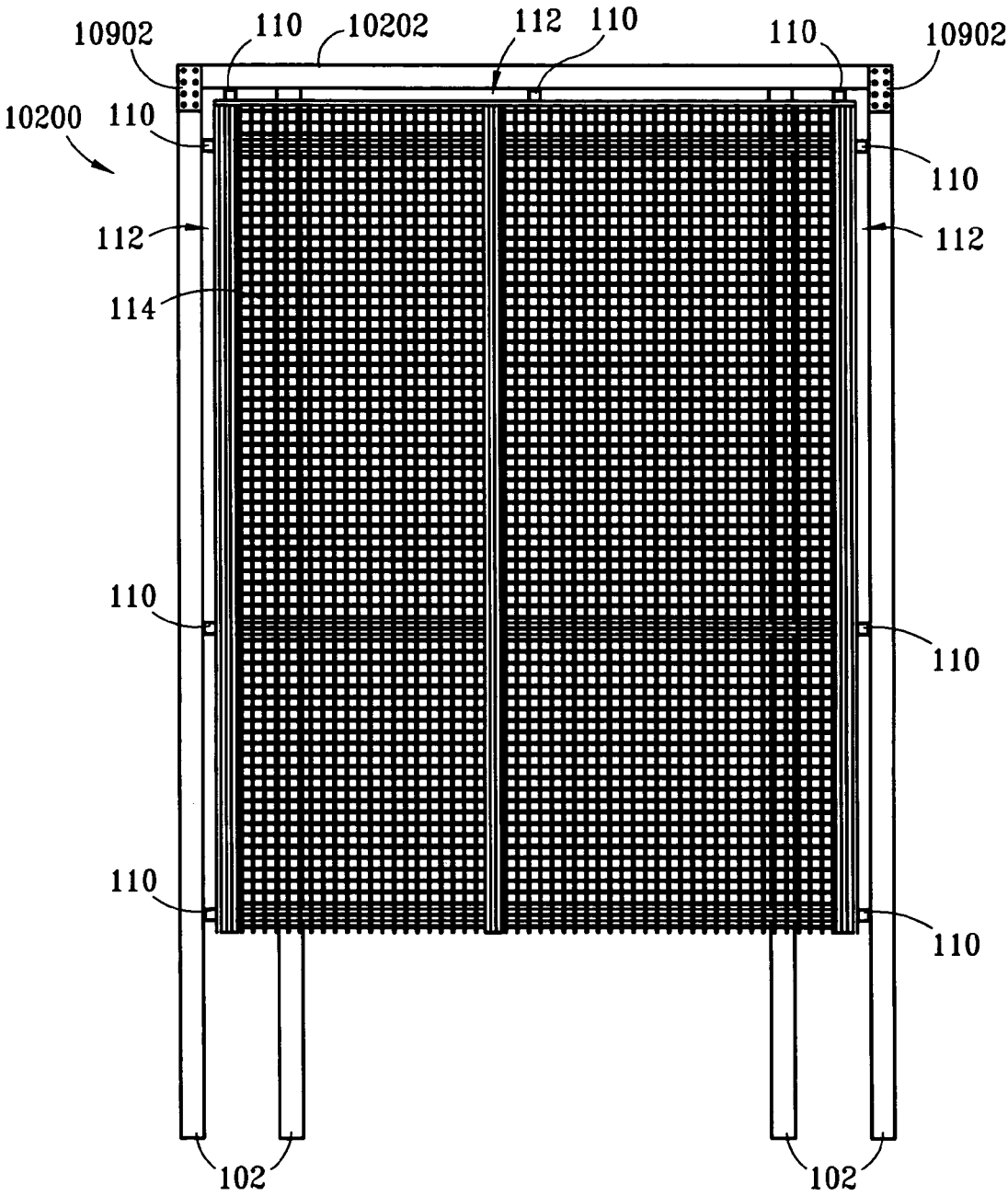
FIG. 110 presents an elevation view of the fence system of FIG. 102 taken along the line 110-110 of FIG. 102.

FIGS. 109 and 110 depict one end of the enclosure 10200, viewed from the exterior and interior sides of the enclosure, respectively. As shown therein, rafters 10202 are preferably mounted and secured to posts 102 via a rafter-post plate 10902, discussed below in further detail with respect to FIG. 116.

Figure 111:
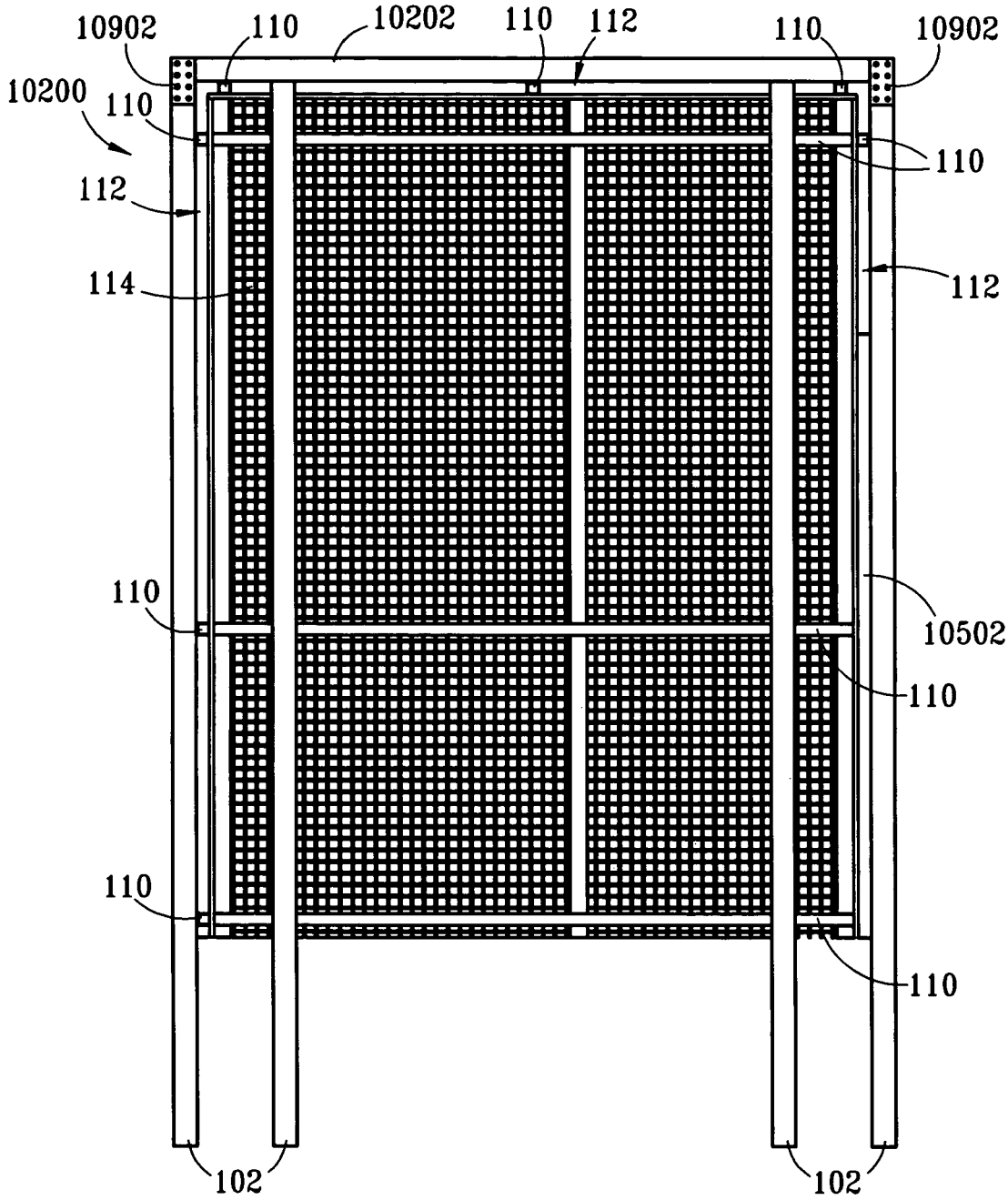
FIG. 111 presents an elevation view of the fence system of FIG. 102 taken along the line 111-111 of FIG. 102.
Figure 112:
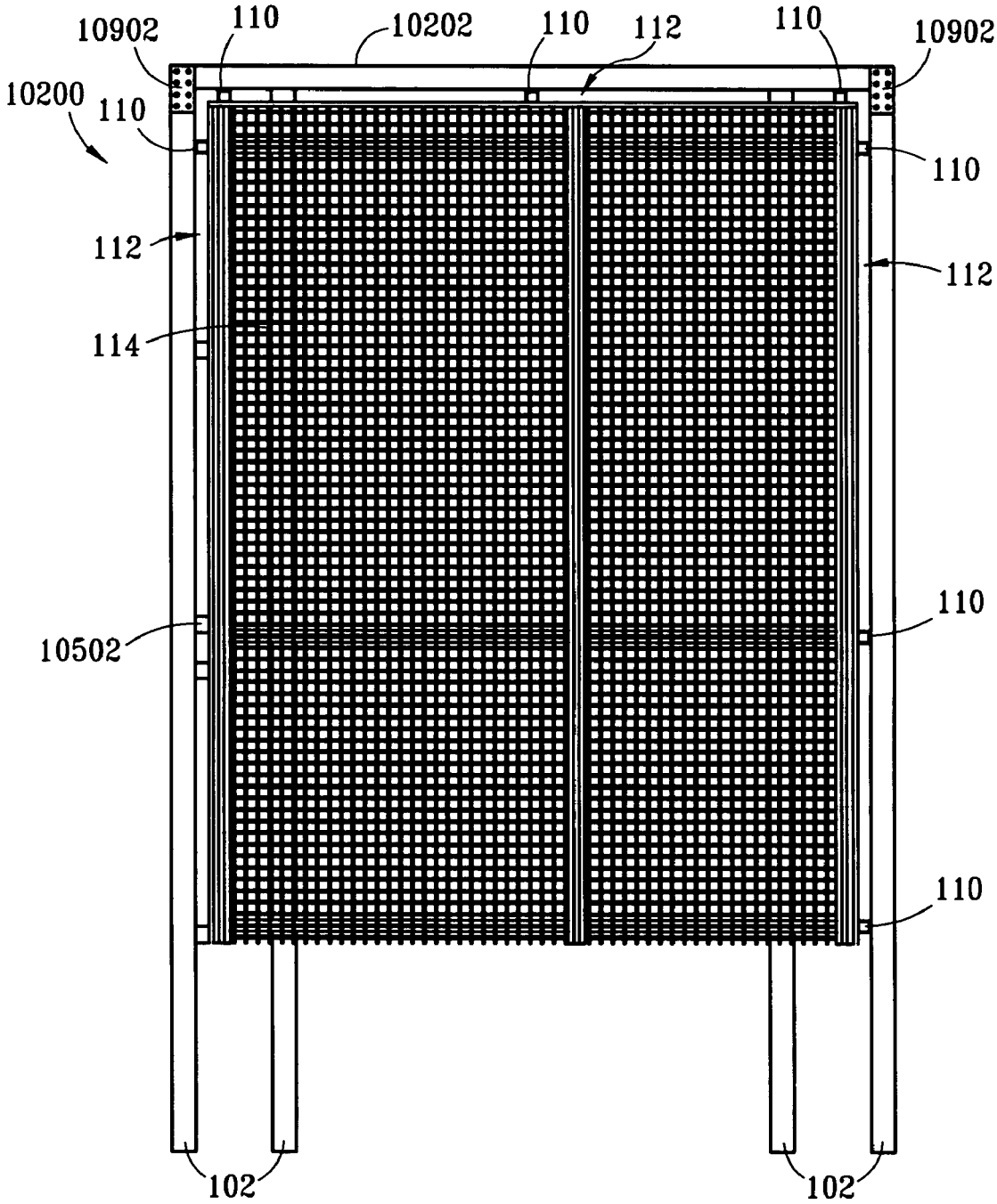
FIG. 112 presents an elevation view of the fence system of FIG. 102 taken along the line 112-112 of FIG. 102.

FIGS. 111 and 112 depict an end of the enclosure 10200 opposite the side depicted in FIGS. 109 and 110, viewed from the exterior and interior sides of the enclosure, respectively.

Figure 113:
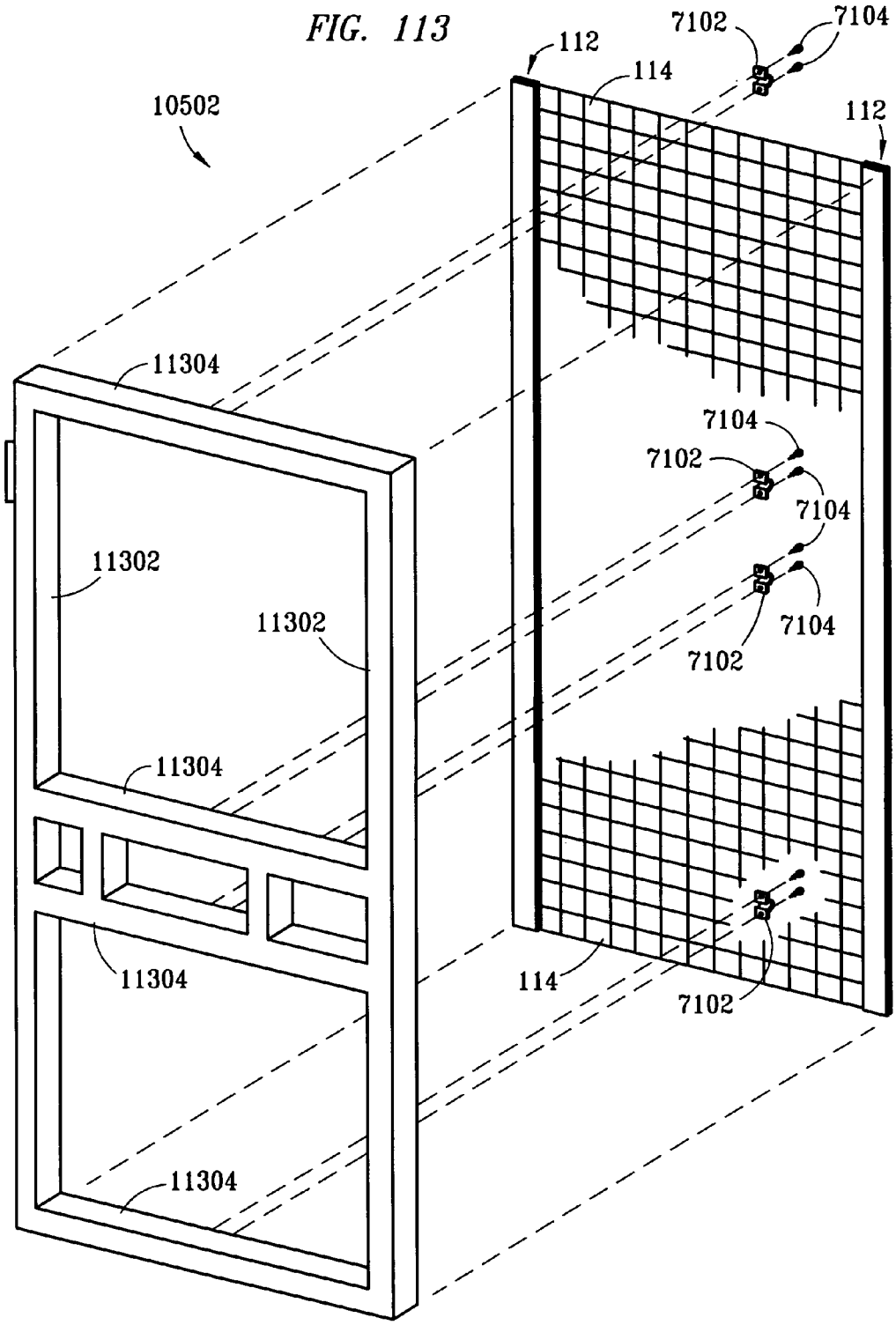
FIG. 113 exemplifies an elevation view of a gate adaptable for use with the fence system of FIG. 102.

FIG. 113 exemplifies, without limitation, details of the structure of the gate 10502 used in conjunction with the enclosure 10200, as described above with respect to FIGS. 105-106. The gate 10502 is sized and configured as needed in a conventional manner. More specifically, the gate 10502 comprises vertical structural members 11302 connected together via horizontal structural members 11304 in a conventional manner. Union strips 112 are preferably positioned on the vertical members 11302, and, as described above, infill material 114 is positioned within channels 112*a* of the union strips 112, and further secured thereto via a suitable clamp, such as described above with respect to FIGS. 71-88, exemplified as bracket 7102, positioned on a horizontal member 11304 intermediate the union strips 112.

Figure 114:
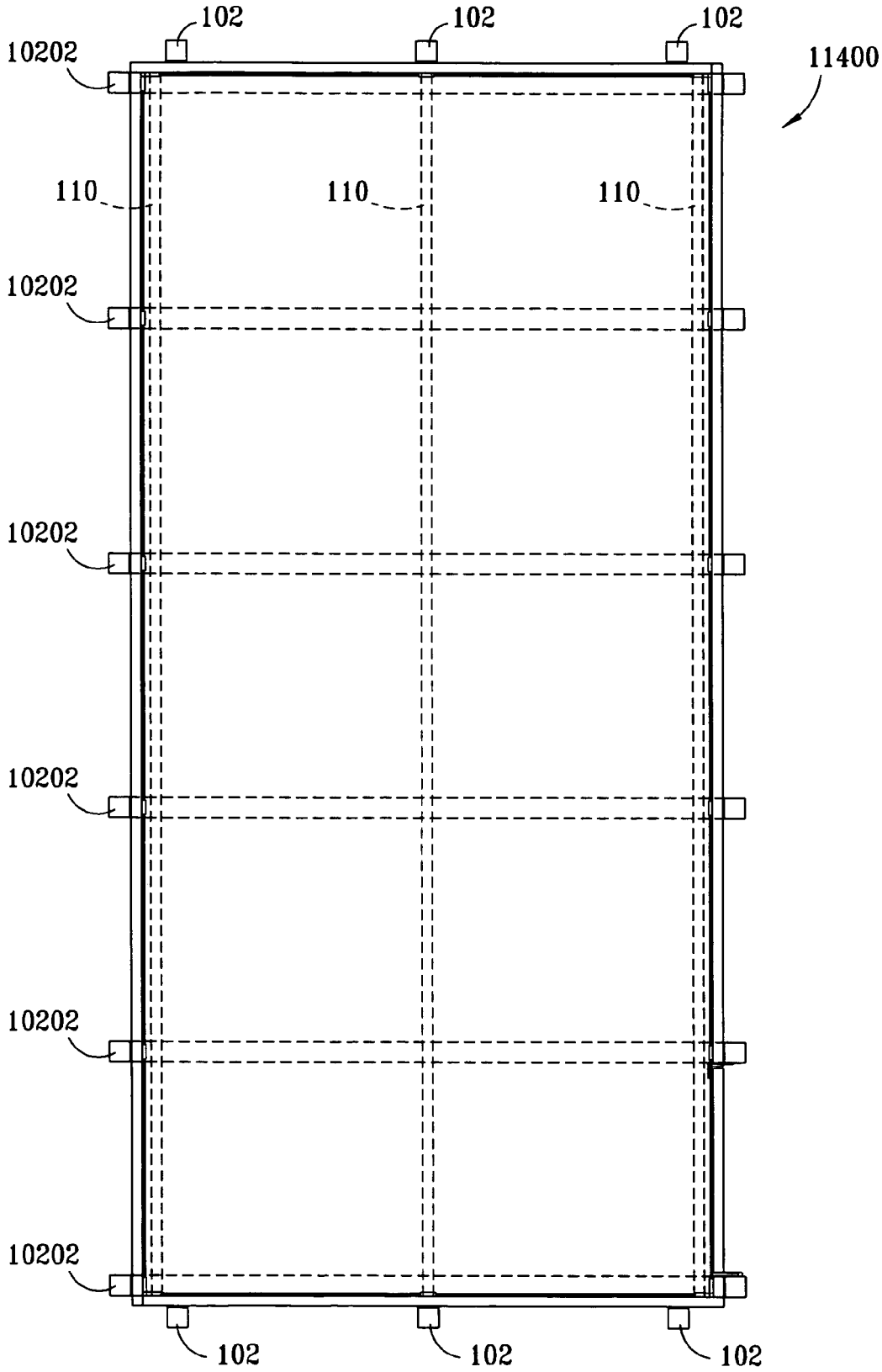
FIG. 114 exemplifies a site plan of a second embodiment of a fence system configured as an enclosure having infill material positioned on the interior of the enclosure and extending across the top of the enclosure in accordance with principles of the present invention.
Figure 115:
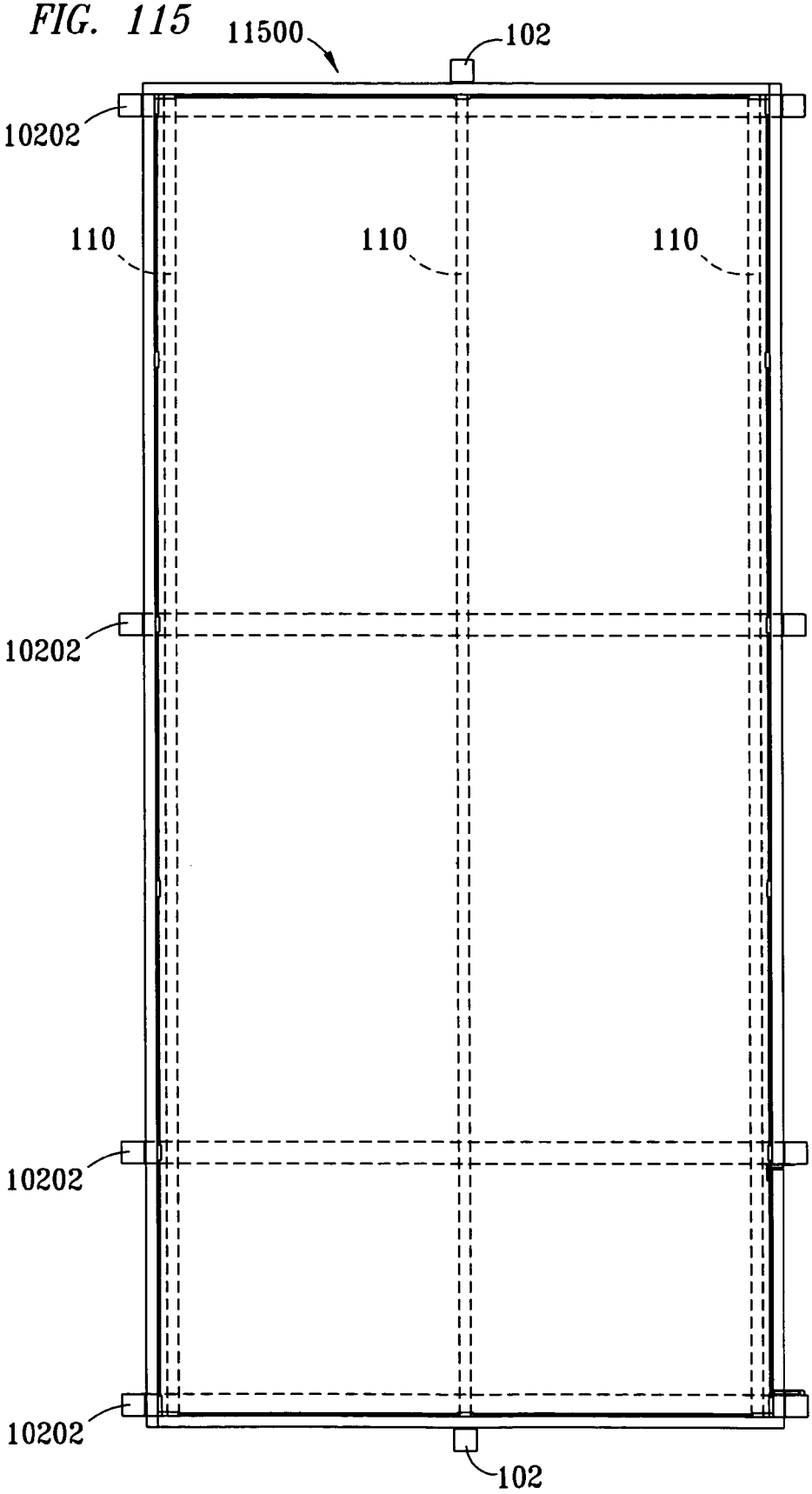
FIG. 115 exemplifies a site plan of a third embodiment of a fence system configured as an enclosure having infill material positioned on the interior of the enclosure and extending across the top of the enclosure in accordance with principles of the present invention.

FIGS. 114 and 115 depict two site plans, alternative to the site plan depicted in FIG. 102, which exemplify alternative embodiments of enclosure 10200 which may be configured in accordance with principles of the present invention. More specifically, FIGS. 114 and 115 exemplify, respectively, how fewer or additional rafters 10202 and posts 102 (not all of which are shown) may be utilized with and distributed about the enclosure.

Figure 116:
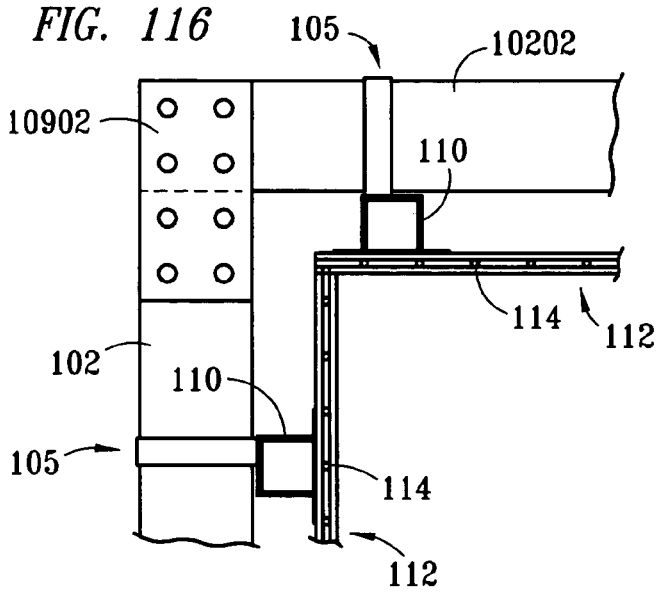
FIG. 116 depicts an elevation view of one preferred embodiment for securing a rafter to a post of an enclosure of FIGS. 102-115.

FIG. 116 exemplifies one preferred embodiment of a rafter-post plate 10902 that may be utilized to secure a rafter 10202 to a post 102. The plate 10902 is preferably a conventional flat plate attached via conventional fasteners (e.g., bolts and nuts) to each respective rafter 10202 and post 102. As also shown in FIG. 116, rails 110, channels 112, and infill material 114, are secured to the post 102 and rafter 10202 as described above with respect to FIGS. 1-101.

By the use of the present invention, a high security fence may be erected, or retrofitted onto posts of a previous fence, using standard sheeted infill material secured to posts that are spaced apart at non-standard intervals, or attached to a wall. The posts, furthermore, may be round or square, and of virtually any size, as depicted in FIGS. 53-60. Still further, sheeted infill material does not require fabrication of a frame for the mesh panels and, therefore, no post-fabrication galvanization, is required. Still further, the union strips 112 contain rough cutting edges that may exist with infill material 114. The fence of the present invention may also be aesthetically appealing.

Figure 117:
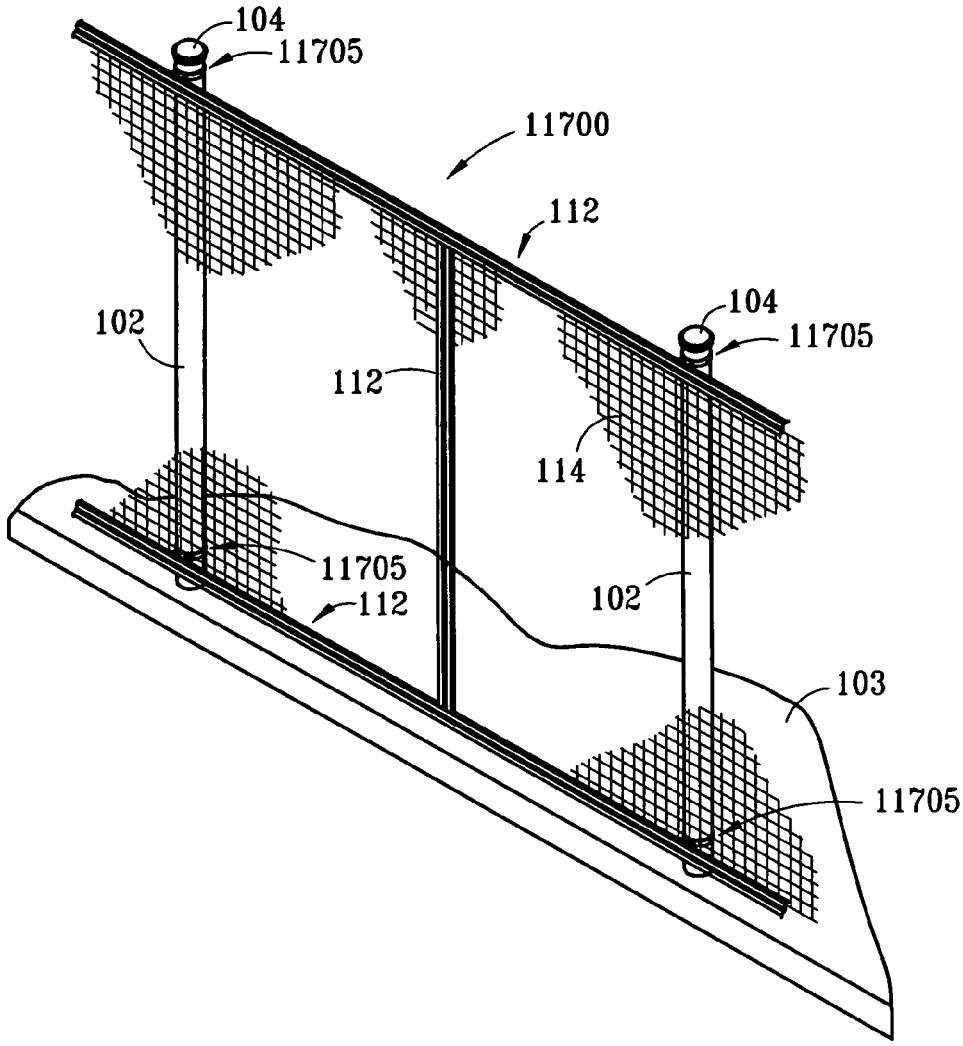
FIG. 117 depicts an alternate embodiment of the fence system of the present invention wherein union strips are secured horizontally directly to posts.

It is understood that the present invention may take many forms and embodiments. Accordingly, several variations may be made in the foregoing without departing from the spirit or the scope of the invention. For example, electrical current may be run through the fence system 100, or a portion thereof, to discourage individuals from touching the fence. A further example is depicted by FIG. 117 wherein in a fence system 11700, union strips 112 are attached horizontally and directly to the posts 102 using channel hangers 11705 substantially similar to the rail hangers 105 (FIGS. 3-5, 19, and 23-52), but adapted for supporting horizontal union strips 112 without using rails 110. Further to FIG. 117, vertically oriented unions strips 112 may optionally be utilized to join or terminate vertical edges of infill material 114.

Figure 120:
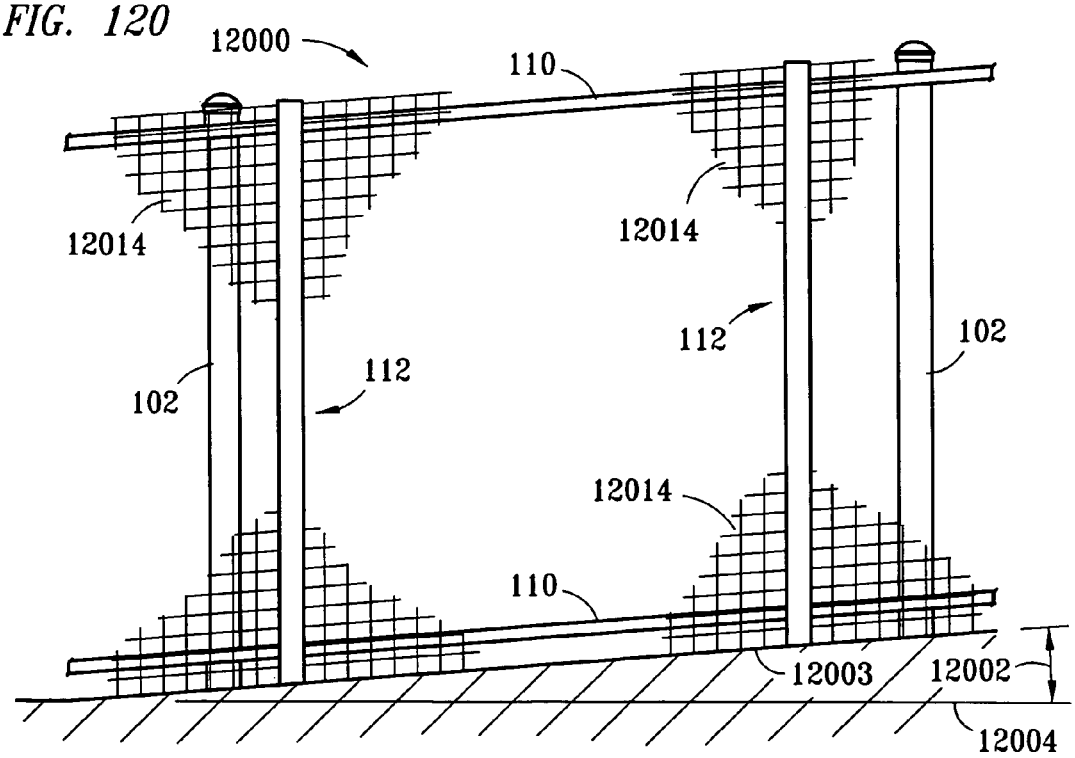
FIG. 120 presents an elevation view of an alternate embodiment of the present invention adapted for non-horizontal grades.

In another example, depicted in FIG. 120 by an embodiment 12000, infill material 12014, such as woven wire mesh, may be utilized having non-vertical wires that may be canted at an angular deviation 12002 from a horizontal plane 12004, while permitting the vertical wires remain substantially vertical, to thereby facilitate implementation of the fence system of the present invention on a graded surface 12003, corresponding to the substantially horizontal surface 103 discussed above with respect to FIGS. 1 and 2.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

The invention claimed is:

1. A fence comprising:

at least two infill materials, each of said at least two infill materials having at least one respective edge;

at least one post;

at least one rail coupled to said at least one post;

at least one union strip coupled to said at least one rail, said at least one rail being thereby interposed between said at least one post and said at least one union strip, said at least one union strip comprising at least three channels, each of two of which channels being configured for receiving an edge of a corresponding one of said at least two infill materials, and at least one of said channels being defined by walls having first ratchet teeth;

at least one fastener extending through said at least one channel defined by walls having first ratchet teeth to said at least one rail; and a cover fitted over said at least one channel defined by walls having first ratchet teeth for precluding access to said at least one fastener, said cover including second ratchet teeth configured for matingly engaging said first ratchet teeth for securing said cover over said at least one channel defined by walls having first ratchet teeth.

2. The fence of claim 1 wherein said system further comprises at least one substantially flat plate extending between said at least a first union strip and a second union strip, and at least one picket positioned on said at least one flat plate.

3. The fence of claim 1 further comprising an electrical power supply connected to said at least two infill materials for running current through said at least two infill materials.

4. The fence of claim 1 wherein said at least one union strip further defines a concave radius interposed between said first and second channels.

5. The fence of claim 1 wherein:

said at least one union strip is fabricated from at least two elongated plates configured and secured together to define said two channels directed in substantially opposing directions; and each of said at least two infill materials include at least one edge confined by one channel of said two channels of said at least one union strip.

6. The fence of claim 1 wherein:

said at least one union strip is fabricated from at least two substantially flat elongated plates; and each of said at least two infill materials include at least one edge portion interposed between said at least two plates of said at least one union strip.

7. The fence of claim 1 wherein:

said at least one union strip is fabricated from at least two shaped elongated plates configured and secured together to define said at least two channels; and each of said at least two infill materials include at least one edge portion confined by a respective one of said at least two channels.

8. The fence of claim 1 wherein:

said at least one union strip is fabricated from at least two elongated plates secured together, said at least two elongated plates being shaped to define said at least two channels; and each of said at least two infill materials include at least one edge portion confined by said one of said at least two channels.

9. The fence of claim 1 wherein:

said at least one union strip includes at least a first and a second union strip, wherein each of said union strips is fabricated from two elongated strips secured together, one of said elongated strips being substantially flat with at least one elongated protrusion, and the other of said elongated strips defining at least one elongated slot configured for receiving said at least one elongated protrusion and further being configured to define with said substantially flat first elongated strip two channels directed in substantially opposing directions; and each of said at least two infill materials include a first edge portion confined within one of said two channels of said first union strip, and a second edge portion confined within one of said two channels of said second union strip.

10. The fence of claim 1 further comprising concertina wire positioned on top of the fence.

11. The fence of claim 1 wherein said at least one post defines a lower portion and an upper portion thereof, and wherein said upper portion is canted at a predetermined angle away from said lower portion.

12. The fence of claim 1 wherein said at least one post defines a lower portion and an upper portion thereof, and wherein said lower portion is substantially vertical, and said upper portion is canted at a predetermined angle away from vertical.

13. The fence of claim 1 wherein said at least one union strip includes at least two first union strips, and wherein said at least one post includes at least three posts, said fence further comprising:

at least two rafters, extending from a top end of one of said at least three posts to a top end of another of said at least three posts;

at least two second union strips extending across said at least two rafters; and said at least one infill material extending between said at least two second union strips across the top of said fence, to thereby form and enclosure.

14. The fence of claim 1 wherein said at least one union strip includes at least a first and second union strip positioned at different elevations, and said at least two infill materials comprise woven wire mesh adapted for fitting between said at least a first and second union strip positioned at different elevations.

15. The fence of claim 1 wherein said at least two infill materials comprise at least one of wire mesh, woven wire mesh, welded wire mesh, expanded metal mesh, perforated panel, steel grate panel, a solid sheet of steel, a solid sheet of stainless steel, a solid sheet of aluminum, and a solid sheet of plastic.

16. The fence of claim 1 wherein said at least one rail comprises at least two vertically-spaced rails interposed between said at least one post and said at least one union strip.

* * * * *